US011761312B2

(12) United States Patent
Lowe et al.

(10) Patent No.: US 11,761,312 B2
(45) Date of Patent: Sep. 19, 2023

(54) MODULAR PERFORATION TOOL

(71) Applicant: Schlumberger Technology Corporation, Sugar Land, TX (US)

(72) Inventors: Erick Lowe, Clamart (FR); Andrew Prisbell, Sugar Land, TX (US); Todd Busch, Alvin, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/811,202

(22) Filed: Jul. 7, 2022

(65) Prior Publication Data

US 2023/0008361 A1 Jan. 12, 2023

Related U.S. Application Data

(60) Provisional application No. 63/219,968, filed on Jul. 9, 2021.

(51) Int. Cl.
*E21B 43/117* (2006.01)
*E21B 43/1185* (2006.01)

(52) U.S. Cl.
CPC ..... *E21B 43/117* (2013.01); *E21B 43/1185* (2013.01)

(58) Field of Classification Search
None
See application file for complete search history.

(56) References Cited

U.S. PATENT DOCUMENTS

| | | | | |
|---|---|---|---|---|
| 7,000,699 | B2 * | 2/2006 | Yang | E21B 17/1057 166/255.2 |
| 9,784,549 | B2 * | 10/2017 | Eitschberger | F42D 1/05 |
| 10,458,213 | B1 * | 10/2019 | Eitschberger | E21B 43/117 |
| 10,689,955 | B1 * | 6/2020 | Mauldin | F16C 35/06 |
| 2019/0264548 | A1 * | 8/2019 | Zhao | E21B 43/119 |
| 2020/0018139 | A1 * | 1/2020 | Eitschberger | E21B 47/09 |
| 2021/0198983 | A1 * | 7/2021 | Eitschberger | E21B 43/117 |
| 2022/0268135 | A1 * | 8/2022 | Eitschberger | E21B 43/1185 |

* cited by examiner

*Primary Examiner* — Matthew Troutman
*Assistant Examiner* — Douglas S Wood
(74) *Attorney, Agent, or Firm* — Jeffrey D. Frantz

(57) ABSTRACT

An apparatus for use in a well bore is described herein. The apparatus includes a one-piece housing having a length in an axial direction from a first end to a second end, and end wall and a sidewall defining a cavity within the housing. The apparatus also includes a frame inside the cavity. The frame includes a charge receptacle, a detonator receptacle, a first electrical contact and a second electrical contact. The apparatus further includes a conductive material coupled with the first electrical contact.

24 Claims, 29 Drawing Sheets

MODULAR PERFORATION TOOL

CROSS-REFERENCE TO RELATED APPLICATIONS

This patent application claims benefit of U.S. Provisional Patent Application Ser. No. 63/219,968 filed Jul. 9, 2021, which is entirely incorporated herein by reference.

FIELD

Embodiments of the present invention generally relate to well perforation in oil and gas recovery. Specifically, embodiments of a modular perforation tool are described herein.

BACKGROUND

Oil wells are holes drilled into the earth, sometimes under water. The holes may descend essentially straight into the earth, or may advance at an angle, or even sideways. The well provides a conduit for oil and gas, or indeed any flowable resource, to flow out of a geologic formation into the hole and up to the surface. The hole is often lined with a support material to keep the flow path open as fluids flow into the conduit. The support material can be a pipe, a concrete lining, or other support. The support material is deployed after drilling the well and solidified as needed.

Openings are formed in the support material to allow fluids to flow into the well from the formation. A perforation tool, sometimes called a perforating gun, is a complex tool that delivers a firing impulse to one or more explosive charges positioned by the perforating gun to direct the blast from the shaped charge in a desired direction. The explosive charges are contained and held in position by a cage, and a firing circuit is electrically connected to the shaped charges. The discharge penetrates the support to create the openings, and often also penetrates a few inches into the formation itself. The extra length of the perforation often aids in developing fluid flow from the formation into the well.

Transportation of perforating assemblies is heavily regulated worldwide, due to the propensity to set off an explosion. In most cases, the firing impulse sub-assembly must be transported separately from the explosive sub-assembly, and the tool assembled in the field. Such restrictions complicate delivering perforation tools to drill sites. Additionally, securing the shaped charges in a desired position in the perforating gun is challenging. Often, the shaped charges must be installed at specific positions in the perforating gun, restricting flexibility in directing the discharge. A perforating gun is needed in the industry that is transportable, easy to assemble, and has more flexibility of operation.

SUMMARY

Embodiments described herein provide an apparatus, comprising a one-piece housing having a first end, a second end opposite the first end, a length in an axial direction from the first end to the second end along a central axis of the housing, an end wall at the first end, and a sidewall joined to the end wall, extending from the first end to the second end, and defining a cavity within the housing; a frame inside the cavity, the frame having a first end facing the end wall of the housing and a second end opposite the first end, the frame comprising a charge receptacle between the first end of the frame and the second end of the frame to accommodate at least a portion of a shaped charge; a detonator receptacle to accommodate a detonator, the detonator receptacle having fluid communication with the charge receptacle; a first electrical contact at the first end of the frame; and a second electrical contact at the second end of the frame; and a conductive material communicatively coupled with the first electrical contact.

Other embodiments described herein provide a perforation gun assembly, comprising two or more gun modules, each gun module comprising a one-piece housing having a first end, a second end opposite the first end, a length in an axial direction from the first end to the second end along a central axis of the housing, an end wall at the first end, and a sidewall joined to the end wall, extending from the first end to the second end, and defining a cavity within the housing, the end wall having a thickness greater than a thickness of the sidewall; a detonator; a frame inside the cavity, the frame having a first end facing the end wall of the housing and a second end opposite the first end, the frame comprising a charge receptacle between the first end of the frame and the second end of the frame to accommodate at least a portion of a shaped charge; a first electrical contact at the first end of the frame; and a second electrical contact at the second end of the frame; a detonator receptacle to accommodate the detonator between the first electrical contact and the second electrical contact; and a conductive material communicatively coupled with the first electrical contact, wherein the first end of the housing of a first gun module of the two or more gun modules is connected to the second end of the housing of a second gun module of the two or more gun modules, and the conductive material of the first gun module is electrically connected to the second electrical contact of the second gun module.

Other embodiments described herein provide an apparatus, comprising at least one processor; a memory having computer readable instructions stored thereon that, when executed by the at least one processor, cause the apparatus to detect an orientation position of one or more shaped charge holders of a perforation gun assembly, the perforation gun assembly comprising two or more gun modules, each gun module comprising a one-piece housing having a first end, a second end opposite the first end, a length in an axial direction from the first end to the second end along a central axis of the housing, an end wall at the first end, and a sidewall joined to the end wall, extending from the first end to the second end, and defining a cavity within the housing, the end wall having a thickness greater than a thickness of the sidewall; a detonator; a shaped charge holder inside the cavity and having a first end facing the end wall and a second end opposite the first end, the shaped charge holder comprising one or more charge receptacles between the first end of the shaped charge holder and the second end of the shaped charge holder, each charge receptacle being configured to accommodate at least a portion of a shaped charge; a first electrical contact at the first end of the shaped charge holder; a second electrical contact at the second end of the shaped charge holder; and a detonator receptacle to accommodate the detonator between the first electrical contact and the second electrical contact; a conductive material communicatively coupled with the first electrical contact, wherein the first end of the housing of a first gun module of the two or more gun modules is connected to the second end of the housing of a second gun module of the two or more gun modules, the conductive material of the first gun module is electrically connected to the second electrical contact of the second gun module, wherein one or more shaped charge holders is rotatable about the central axis within the corresponding housing; and a rotary assembly for each rotatable shaped charge holder, comprising one or more magnets and coils configured to cause the rotatable shaped charge holder to rotate based on an electric current supplied to the coils; and to cause the electric current to be supplied to the coils to cause the rotatable shaped charge holders to rotate to an instructed position with respect to the corresponding housing.

Other embodiments described herein provide a method, comprising detecting, by a processor, an orientation position of one or more shaped charge holders included in a perforation gun assembly, comprising two or more gun modules, each gun module comprising a housing having a first end, a second end opposite the first end, a length in an axial direction from the first end to the second end along a central axis, an end wall at the first end, and a sidewall joined to the end wall, extending from the first end to the second end, and defining a cavity within the housing, the end wall having a thickness greater than a thickness of the sidewall; a detonator; a shaped charge holder inside the cavity and having a first end facing the end wall and a second end opposite the first end, the shaped charge holder comprising one or more charge receptacles between the first end of the shaped charge holder and the second end of the shaped charge holder, each charge receptacle being configured to accommodate at least a portion of a shaped charge; a first electrical contact at the first end of the shaped charge holder; a second electrical contact at the second end of the shaped charge holder; and a detonator receptacle to accommodate the detonator between the first electrical contact and the second electrical contact; a conductive material communicatively coupled with the first electrical contact, wherein the first end of the housing of a first gun module of the two or more gun modules is connected to the second end of the housing of a second gun module of the two or more gun modules, the conductive material of the first gun module is electrically connected to the second electrical contact of the second gun module, wherein one or more shaped charge holders is rotatable about the central axis within the corresponding housing; and a rotary assembly for each rotatable shaped charge holder, comprising one or more magnets and coils configured to cause the rotatable shaped charge holder to rotate based on an electric current supplied to the coils; and causing the electric current to be supplied to the coils to cause the rotatable shaped charge holders to rotate to an instructed position with respect to the corresponding housing.

Other embodiments described herein provide a non-transitory computer readable medium having instructions stored thereon that, when executed by at least one processor, cause an apparatus to detect an orientation position of one or more shaped charge holders included in a perforation gun assembly, comprising two or more gun modules, each gun module comprising a housing having a first end, a second end opposite the first end, a first length extending in an axial direction from the first end of the housing to the second end of the housing along a central axis, and at least one sidewall defining a cavity within the housing, the at least one sidewall having a first thickness in a direction parallel to the central axis between a first exterior surface of the at least one sidewall on the first end of the housing and a first interior surface portion of the at least one sidewall on a first end-side of the cavity, and a second thickness in a radial direction with respect to the central axis, the second thickness being less than the first thickness and between a second exterior surface of the at least one sidewall and a second interior surface portion of the at least one sidewall, the second interior surface portion of the at least one sidewall being between the first interior surface portion of the at least one sidewall and the second end of the housing; a detonator; at least one shaped charge holder of the one or more shaped charge holders inside the cavity within the housing, the at least one shaped charge holder having a first end facing the first interior surface portion of the housing, a second end opposite the first end, a second length less than the first length extending from the first end of the at least one shaped charge holder to the second end of the at least one shaped charge holder along the central axis, one or more charge receptacles between the first end of the at least one shaped charge holder and the second end of the at least one shaped charge holder, each of the one or more charge receptacles being configured to accommodate at least a portion of a shaped charge, a first electrical contact on a first end-side of the at least one shaped charge holder, a second electrical contact on a second end-side of the at least one shaped charge holder, and a detonator receptacle configured to accommodate the detonator between the first electrical contact and the second electrical contact; a conductive material communicatively coupled with the first electrical contact, wherein the first end of a first gun module of the two or more gun modules is connected to the second end of a second gun module of the two or more gun modules, the conductive material of the first gun module is electrically connected to the second electrical contact of the second gun module, and the shaped charge holder of is rotatable about the central axis within the housing; and a rotary assembly comprising one or more magnets and coils configured to cause the shaped charge holder of the corresponding one of the first gun module or the second gun module to rotate based on an electric current supplied to the coils; and cause the electric current to be supplied to the coils included in at least one of the first gun module or the second gun module to cause at least one of the shaped charge holder included in the first gun module or the shaped charge holder included in the second gun module to rotate about the central axis to an instructed position with respect to the corresponding housing of the first gun module or the second gun module.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The modular perforation tools described herein are configured to be transportable in a single parcel, and to be scalable to any desired degree in the field. The tools described herein are also feature configurable discharge directionality and spacing.

Figure 1:
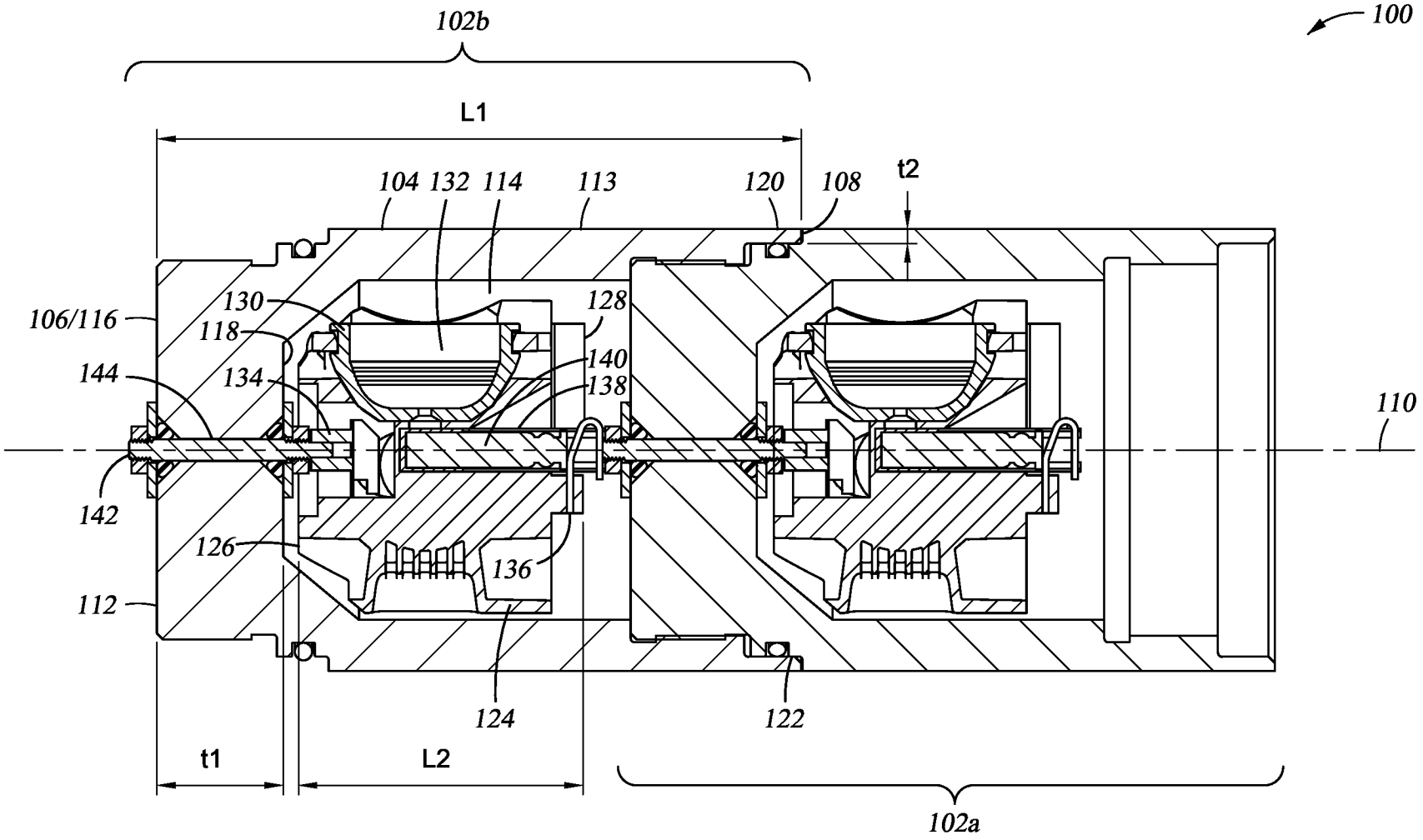
FIG. 1 is a cross-sectional view of a portion of a perforation tool according to one embodiment.

FIG. 1 is a cross-sectional view of a perforation tool 100 according to one embodiment. Perforation tools conventionally comprise multiple pieces, such as carriers, pressure sealing bulkheads and conducting feedthroughs, electrical wires, ballistic detonating cord, boosters, detonators, electronic switches, and shaped charges. The perforation tool 100, and components thereof, reduces the quantity of components into minimal parts while, in many cases, maintaining the function of one or more omitted conventional components. In some embodiments, one or more gun modules included in the perforation tool comprise a one-piece carrier/bulkhead combination, simplified feedthrough, and an explosive cartridge to house explosive charges, and may include electronics.

The perforation tool 100 is a perforation gun assembly configured for use in a well bore. The perforation tool 100 comprises gun modules 102*a* and 102*b* (collectively referred to herein as "gun module 102," or to refer to more than one collection of the gun modules 102*a* and 102*b*, "gun modules 102"). In some embodiments, the perforation tool 100 comprises a plurality of gun modules 102. In an assembled state, two or more gun modules 102 such as the gun module 102*a* and the gun module 102*b* are attached to one another such that a first end of one of the gun modules 102 is inserted into a second end of another gun module 102. Two or more of the gun modules 102 may be threaded together, press-fit together, and/or attached end-to-end and fixed together by one or more fasteners.

Each gun module 102 comprises a housing 104 having a first end 106, a second end 108 opposite the first end 106, a first length L1 extending in an axial direction from the first end 106 of the housing 104 to the second end 108 of the housing 104 along a central axis 110, an end wall 112 at the first end 106, and at least one sidewall 113 joined to the end wall 112 around a perimeter thereof and extending in an axial direction parallel to the central axis 110 from the first end 106 to the second end 108, the sidewall 113 defining a cavity 114 within the housing 104.

The end wall 112 has a thickness t1 in a direction parallel to the central axis 110 between an exterior surface 116 of the end wall 112 at the first end 106 of the housing 104 and an interior surface 118 of the end wall 112 at the first end 106 on a first end-side of the cavity 114.

The sidewall 113 has a thickness t2 in a radial direction with respect to the central axis 110. The thickness t2 is less than the thickness t1. The thickness t2 is between an exterior surface 120 of the sidewall 113 and an interior surface 122 of the sidewall 113. The interior surface 122 of the sidewall 113 is between the interior surface 118 of the end wall 112 and the second end 108 of the housing 104.

The gun module 102 also includes a frame 124 inside the cavity 114 within the housing 104. The frame 124 has a first end 126 facing the end wall 112, specifically facing the interior surface 118, of the housing 104, a second end 128 opposite the first end 126, and a second length L2 less than the first length L1 extending from the first end 126 of the frame 124 to the second end 128 of the frame 124 along the central axis 110.

The frame 124 includes one or more charge receptacles 130 between the first end 126 of the frame 124 and the second end 128 of the frame 124. Each of the one or more charge receptacles 130 is configured to accommodate at least a portion of a shaped charge 132. A first electrical contact 134 is at the first end 126 of the frame 124, on a first end-side of the frame 124. A second electrical contact 136, which may be a spring or pin, is at the second end 128 of the frame 124, on a second end-side of the frame 124. A detonator receptacle 138 is configured to accommodate a detonator 140 between the first electrical contact 134 and the second electrical contact 136. The frame 124 can be a tubular or cylindrical housing or another structure that can receive explosive charges. The frame 124 can be a one-piece structure, and can be molded or 3D printed.

The detonator receptacle 138 is positioned in the frame 124 along the central axis 110. The shaped charge receptacle 130 is adjacent to the detonator receptacle 138. In an assembled state, the detonator 140 is located in the detonator receptacle 138 adjacent to the shaped charge receptacle 130, and is therefore capable of initiating the shaped charge 132 directly, as opposed to using ballistic transfer devices, such as traditional boosters and detonator cord, to bring the ballistic discharge of the detonator to the shaped charge. In some embodiments, the frame 124 comprises two or more shaped charge receptacles 130 and multiple shaped charges 132 that are azimuthally arranged with respect to the central axis 110 and positioned to be directly initiated by the centrally-located detonator 140. In such cases, each shaped charge receptacle 130 has a narrow end adjacent to the detonator receptacle 138 and pointing toward the detonator receptacle 138 so that each shaped charge receptacle 130 can receive a ballistic discharge from a detonator 140 housed within the detonator receptacle 138 to initiate the shaped charge therein. In such cases, the azimuthally distributed shaped charges are usually located at a single axial plane of the gun module 102.

Alternately, the detonator receptacle 138 can be configured or located such that there is not direct ballistic transfer between the detonator 140 and the shaped charge or charges 132. In such cases, detonator cord and boosters can be used for the ballistic transfer. In the embodiments described herein, detonator cords and boosters are not needed because the frames are configured for direct ballistic transfer from the detonator to the shaped charge.

The gun module 102 additionally includes a conductive material 142 that is communicatively coupled with the first electrical contact 134. The first end 106 of the housing 104 of the gun module 102*a* is connected to the second end 108 of the housing 104 of the gun module 102*b* such that first end of the housing 104 of the gun module 102*a* is inserted into the second end 108 of the housing 104 of the gun module 102*b* and the conductive material 142 of the gun module 102*a* is electrically connected to the second electrical contact 136 of the gun module 102*b* when the gun module 102*a* and the gun module 102*b* are in an assembled state. The conductive material 142 can be a metal bar or wire that extends through a via 144 formed within the first end 106 of the housing 104. The conductive material 142 protrudes from the exterior surface 116 of the end wall 112 away from the first end 106 of the housing 104. The conductive material 142 also protrudes from the interior surface 118 of the end wall 112 into the first end-side of the cavity 114. Thus, the conductive material 142 provides electrically connectivity through the end wall 112 of the housing 104 to connect the first electrical contact 134 of one gun module with the second electrical contact 136 of another gun module.

The first electrical contact 134 of the frame 124 can be configured to receive a protruding portion of the conductive material 142 when the frame 124 and the housing 104 are in an assembled state. Here, the conductive material 142 is exposed to the interior of the cavity 114 and the first electrical contact 134 of the frame 124 has a geometry configured to contact the conductive material 142 in the assembled state. In one example, the first electrical contact 134 is a hollow cylinder shape to receive the protruding rod or wire of the conductive material 142 within the central hollow of the hollow cylinder shape.

The second electrical contact 136 of the frame 124 can be configured to receive a protruding portion of the conductive material 142 from another gun module 102 when the frame 124 and the housing 104 are in an assembled state, and a next gun module 102 is attached. Here, the conductive material 142 is exposed to the exterior of the housing 104 and the second electrical contact 136 of the frame 124 has a geometry configured to contact the conductive material 142 of a next gun module 102 in the assembled state. In this case, the conductive material 142 of the gun module 102*a* protrudes away from the first end 106 of the housing 104 of the gun module 102*a* and is in contact with the second electrical contact 136 of the gun module 102*b* when the gun module 102*a* and the gun module 102*b* are in the assembled state. The second electrical contact 136 can also have a hollow cylinder shape to receive the bar or wire of the conductive material within the hollow of the hollow cylinder shape.

Generally, there are two main sub-assemblies of a gun module 102 described herein, the housing 104 and the frame 124. The housing 104 is a one-piece housing configured to serve as a combined carrier/bulkhead/feedthrough sub-assembly, and the frame 124 is configured to serve as a combined electronic/ballistic sub-assembly.

The housing 104 is configured having the thickness t1 of the end wall 112 at the first end 106 of the housing 104 to provide a pressure sealing bulkhead that isolates pressure between the shaped charges 132 held by the frames 124 in sequentially assembled gun modules 102. Effectively, the solid end wall 112 of material in the first end 106 acts as the separator between the gun modules 102*a* and 102*b* such that instead of ordinarily being two pieces, the first end 106 of the gun module 102*a* directly provides pressure isolation for the gun module 102*b*, as a bulkhead member would for a conventional perforation assembly. Conventionally, pressure sealing bulkheads are a separate component between multiple gun carriers, adding to the complexity, size, and difficulty of assembly and transport of a conventional perforation tool. The integration of the pressure sealing bulkhead into a one-piece housing within which a shaped charge carrying frame such as the frame 124 is inserted makes it possible to simplify the processes of manufacturing, transporting, and assembly of a perforation tool while maintaining the pressure isolation capabilities of a traditionally separate pressure sealing bulkhead.

The frame 124 is configured to accommodate control electronics, wiring, electrical contact, ballistic, and detonator devices into a singular modular holder that is readily insertable and/or combinable with the housing 104. The frame 124 can be configured to be hot-swappable alone, or combined with installed or attached electronics, wiring, ballistics or detonator devices to facilitate the changing of internal components for different perforation tool objectives. For example, differently configured frames, frames configured to accommodate different quantities of shaped charges, insertion or removal of one or more shaped charges, inclusion of differently-shaped shaped charges, usage of a frame 124 that has a different orientation of the shaped charge receptacles 130 or some other suitable variation, is optionally made possible by the modular capabilities of the housing 104 and the frame 124.

In some embodiments, one or more of the gun modules 102*a* and 102*b* excludes one or more of the first electrical contact 134, the second electrical contact 136 or the conductive material 142 and the perforation tool 100 is configured to facilitate wire connections between components of different gun modules 102 included in the perforation tool 100. In some embodiments, the wire connections between different gun modules 102 couple electrical contacts that are included in the frame 124 of different gun modules 102. In some embodiments, the wire connections between different gun module 102 connect to the detonator 140.

Figure 2:
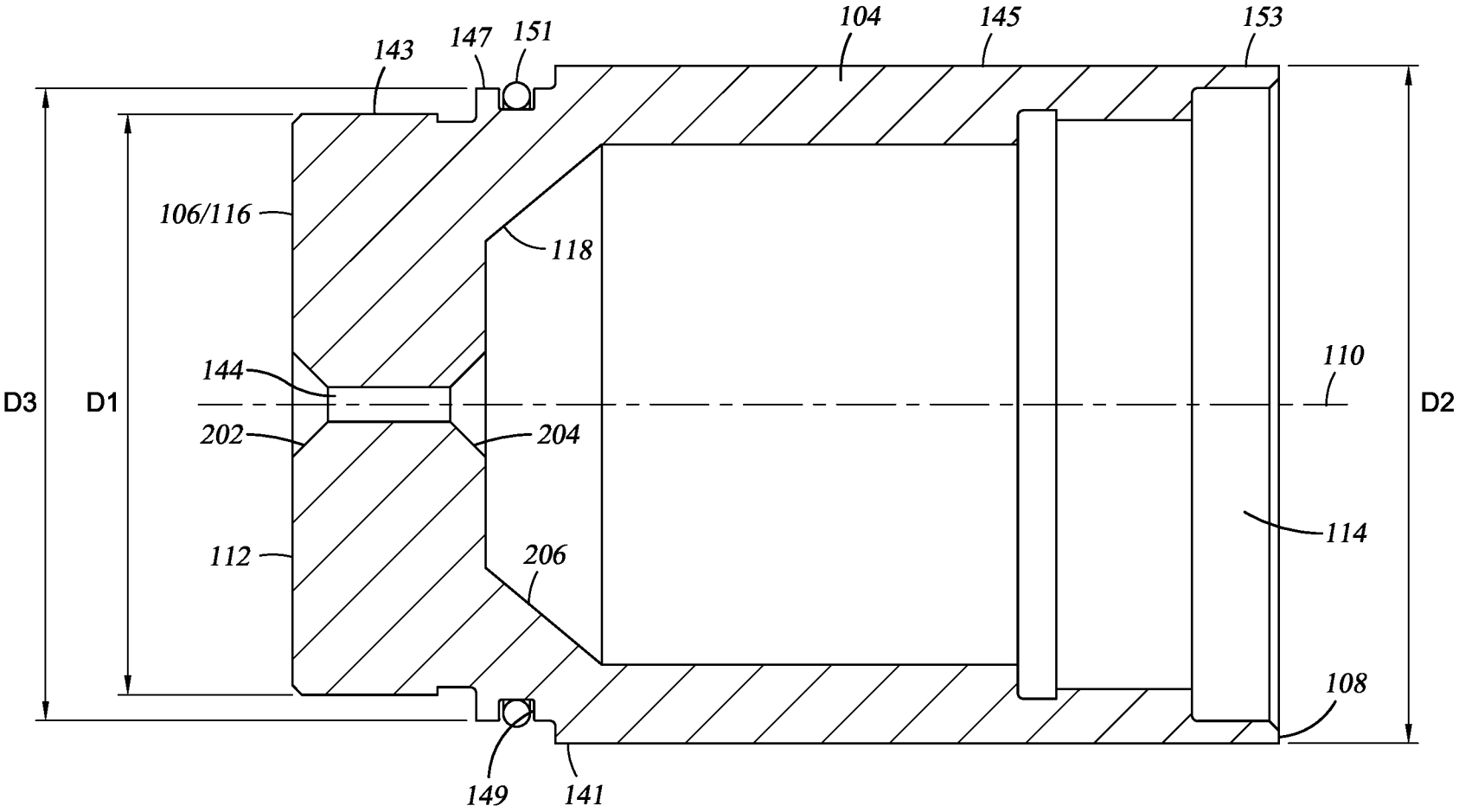
FIG. 2 is a cross-sectional view of housing according to one embodiment.

FIG. 2 is a cross-sectional view of a housing 104 according to one embodiment. The housing 104 of FIG. 2 is cylindrical and symmetric with respect to the central axis 110. A first diameter D1 of the first end 106 of the housing 104 (i.e. a diameter of the end wall 112) is less than a second diameter D2 of the second end 108 of the housing 104. The first end 106 of the housing 104 makes it possible for a first gun module 102 such as the gun module 102*a* (see FIG. 1) to be inserted into the second end 108 of the housing 104 of a second gun module such as the gun module 102*b* (see FIG. 1). In some embodiments, the housing 104 has some other suitable shape that is capable of mating with one or more other housings of sequentially assembled gun modules 102. For example, the housing may have no end wall, but may have a tapered sidewall 113 that comes to a pointed or rounded end.

The via 144 extends through the end wall 112 of the housing 104 at the first end 106 of the housing 104. The via 144 has a tubular configuration with a first conical portion 202 on a first-end side of the via 144 and a second conical portion 204 on a cavity-side of the via 144. The first conical portion 202 is formed within the end wall 112 such that an area of an opening at the exterior surface 116 of the end wall 112 at the first end 106 of the housing 104 is greater than a cross-sectional area of the via 144 in a plane parallel to the exterior surface 116. The second conical portion 204 is formed within the end wall 112 such that an area of an opening at the interior surface 118 of the end wall 112 on the first end-side of the cavity 114 is greater than the area of the via 144 in the plane parallel to the exterior surface 116. The conical portions 202 and 204 can provide a location to dispose a crush seal for some embodiments (as shown, for example, in FIG. 3). In other embodiments, the conical portions 202 and 204 can make it easier to route the conductive material 142 (see FIG. 1) through the via 144. In some embodiments, the via 144 is optionally coated with an insulating material and filled with the conductive material 142 such that the conductive material 142 would not need to be separately insulated. In some embodiments, one or both of the conical portions 202 and 204 is omitted.

The housing 104 makes it possible to shorten the length of a perforation tool by integrating a conventional carrier, bulkhead and feedthrough members into a single unitary one-piece housing. Additionally, by reducing the quantity of components in the perforation tool, manufacturability of the tool is simplified. The housing 104, for example, can be manufactured by machining bar stock, forging, casting, milling, molding, or some other suitable process to have the discussed features.

The housing 104 has a slanted surface 206 on the first-end side of cavity 114. In some embodiments, the slanted surface 206 provides structural support for the housing 104 while maximizing an interior space of the cavity 114. Here, the surface 206 has a frustoconical shape, with a straight taper, but in other cases the surface 206 could have a curved or segmented taper. In some embodiments, the slanted surface 206 could assist with the alignment and insertion of the frame 124 (see FIG. 1) into the housing 104. In some embodiments, the first-end side of cavity 114 is rounded. In some embodiments, the first-end side of cavity 114 is flat and parallel to the exterior surface 116. In some embodiments, the geometry of the first-end side of cavity 114 is based on a mode by which the housing 104 is manufactured.

The housing 104 has an outer wall 141 that has varying diameter along the length of the housing 104. A first portion 143 of the outer wall 141 has the diameter D1 and a second portion 145 of the outer wall 141 has the second diameter D2. Between the first portion 143 and the second portion 145 is a third portion 147 of the outer wall 141, that has a third diameter D3 between the first diameter D1 and the second diameter D2. The third portion 147 of the outer wall 141 has a groove 149 formed therein for receiving a seal member 151, such as an o-ring. The housing 104 has a rim 153 at the second end 108 thereof for overlapping and engaging with the third portion 147 of the housing 104 of another gun module to provide sealing engagement between two gun modules.

Figure 3:
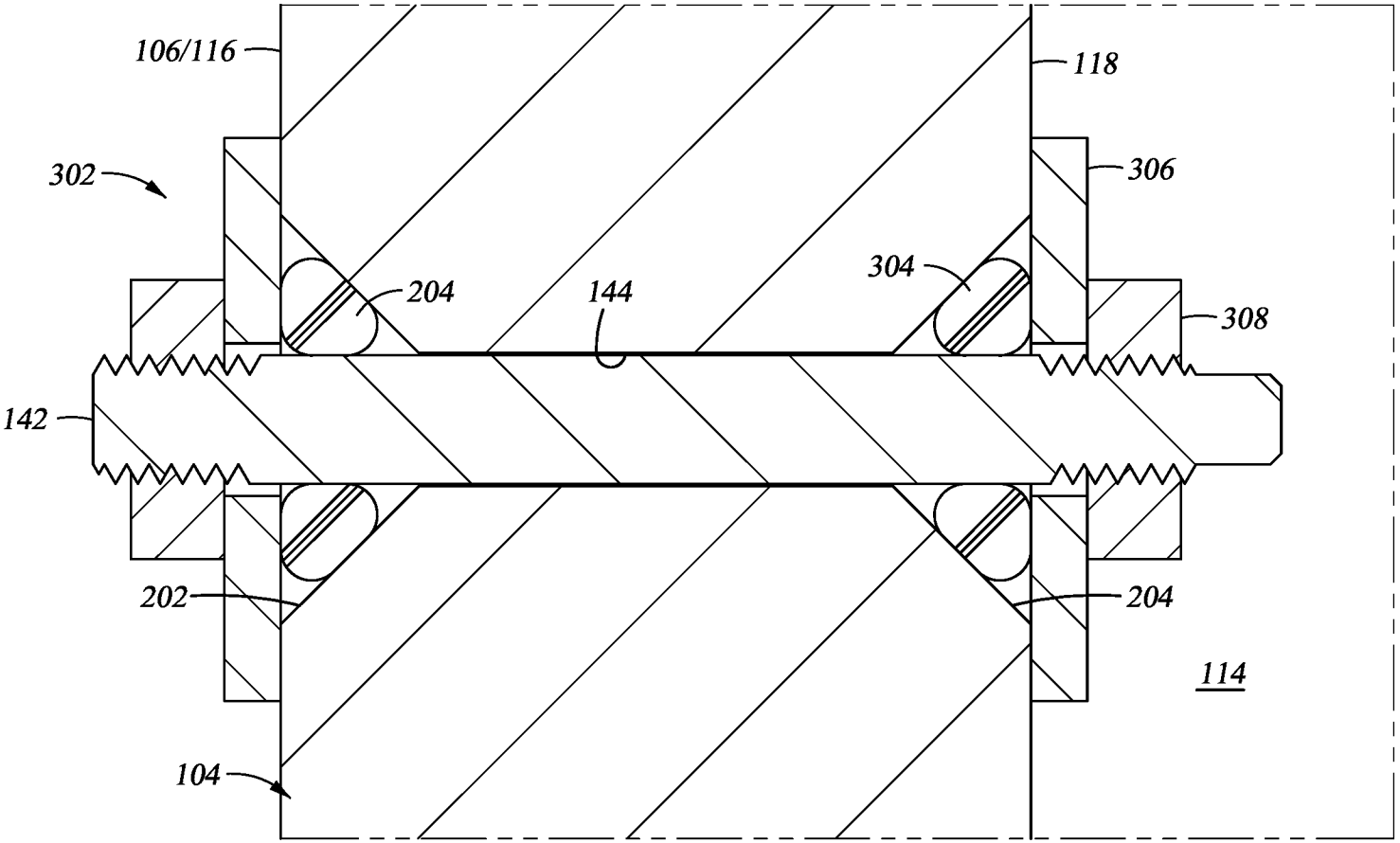
FIG. 3 is a cross-sectional view of a feedthrough and seal structure according to one embodiment.

FIG. 3 is a cross-sectional view of a feedthrough and seal structure 302 according to one embodiment. The feedthrough and seal structure 302 facilitates electrical connection through each gun module 102 (see FIG. 1), but prevents wellbore pressure from entering the housing 104 of an adjacent gun module 102 after a previous gun module 102 has discharged the shaped charges 132 (see FIG. 1) therein. If wellbore pressure entered an adjacent gun module 102, the adjacent gun module 102 would become flooded through the perforation holes. The feedthrough and seal structure 302 prevents intrusion of well fluids from one gun module into the adjacent gun module 102 or perforation tool. The feedthrough and seal structure 302 can be used with the housing 104 described herein.

The feedthrough and seal structure 302 is a crush seal-type comprising o-rings 304 surrounding the conductive material 142 within each of the conical portions 202 and 204 of via 144, and washers 306 surrounding conductive material 142 and in contact with the exterior surface 116 at the first end 106 of the housing 104 and in contact with the interior surface 118 within the cavity 114 of the housing 104. Nuts 308 are threaded onto the conductive material 142 to keep the washers 306 tight against the housing 104, hold the conductive material 142 in place, and provide protection against wellbore pressure that could otherwise compromise an adjacent gun module 102 by way of the via 144.

Figure 4:
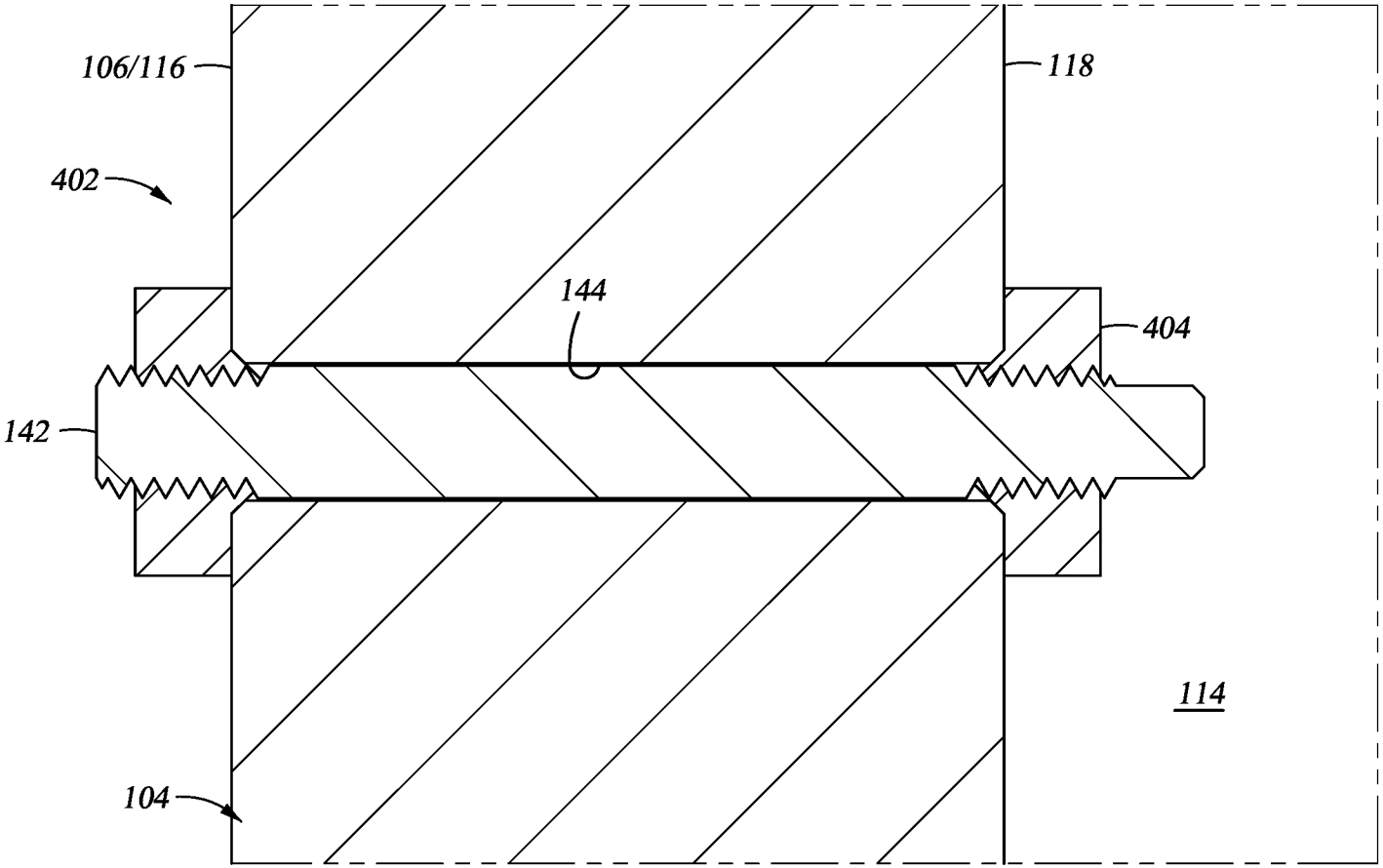
FIG. 4 is a cross-sectional view of a feedthrough and seal structure according to another embodiment.

FIG. 4 is a cross-sectional view of a feedthrough and seal structure 402 according to another embodiment. The feedthrough and seal structure 402 facilitates electrical connection through each gun module 102 (see FIG. 1), but, like the structure 302, prevents wellbore pressure from entering the housing 104 of an adjacent gun module 102 after discharge thereof. The feedthrough and seal structure 402 can also be used with the housing 104 described herein.

The feedthrough and seal structure 402 is a sealing nut-type structure comprising sealing nuts 404 threaded to the conductive material 142. The via 144 in this example has no conical portions. The sealing nuts 404 surround the conductive material 142 and are in contact with the exterior surface 116 at the first end 106 of housing 104 and in contact with the first-end interior surface 118 within the cavity 114 of the housing 104. The sealing nuts 404 comprise a deformable portion that is pressed into the via 144 when threaded onto the conductive material 142 and tightened against the housing 104. The sealing nuts 404 hold the conductive material 142 in place and provide protection against wellbore pressure that could otherwise compromise an adjacent gun module 102 by way of the via 144.

Figure 5:
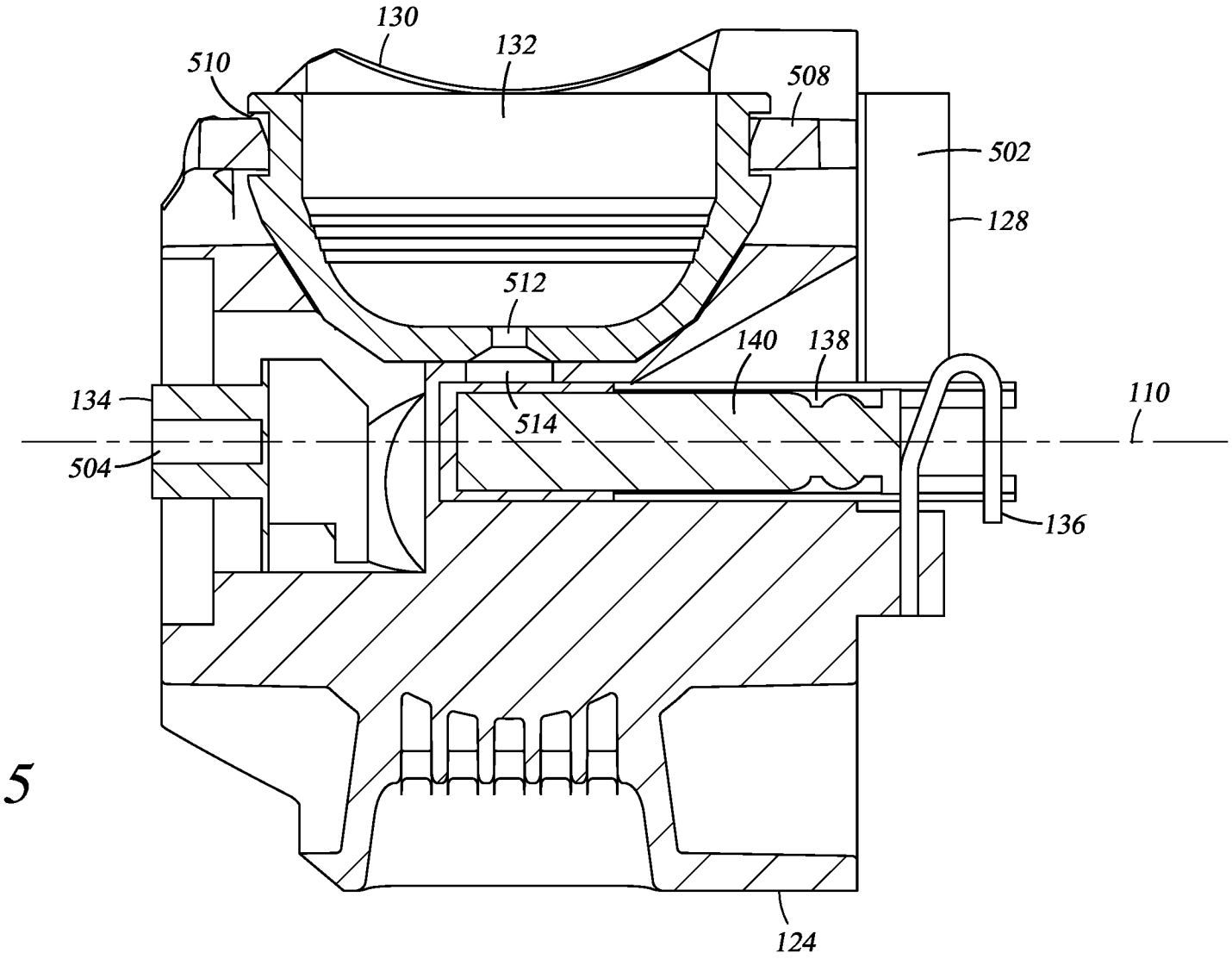
FIG. 5 is a cross-sectional view of frame according to one embodiment.

FIG. 5 is a cross-sectional view of the frame 124, which is one embodiment of a frame that can be used with the apparatus and methods described herein. The frame 124 is shown here with the detonator 140 installed in the detonator receptacle 138 along the central axis 110. The frame 124 also includes a detonator transport receptacle 502 at the second end 128 of the frame 124. The detonator transport receptacle 502 is configured to accommodate the detonator 140 in an unarmed state, spaced apart from any shaped charge 132 or any ballistic conduit to any of the shaped charges 132, and prevented from being able to initiate one or more of the shaped charges 132. The detonator 140 can be inserted into the detonator transport receptacle 502 for transportation to a use site to prevent unwanted activation and discharge of the charges 132, and to deploy the frame 124 in a gun module the detonator 140 can be removed from the detonator transport receptacle 502 and inserted into the detonator receptacle 138 to arm the gun module. The detonator transport receptacle 502 is optional and may be omitted in some frame embodiments described herein.

The frame 124 also includes a conductive material receptacle 504 in the first electrical contact 134 for receiving the conductive material 142 (see FIG. 1) in a corresponding gun module 102 (see FIG. 1) within which the frame 124 is included.

The shaped charge 132 is inserted into the shaped charge receptacle 130. The frame 124 includes clips 508 configured to position the shaped charge 132 in the shaped charge receptacle 130. In some embodiments, the shaped charge receptacle 130 is configured to position the shaped charge 132 by press-fitting, threading with the shaped charge 132, or by way of some other suitable manner. The clips 508 flex outward to allow the body of the shaped charge to pass by upon application of pressure, and then flex inward to engage with a groove 510 in the shaped charge body. The shaped charge 132 includes an opening 512 at an end of the shaped charge 132 to provide fluid communication between the detonator receptacle 138 and explosive material of the shaped charge 132. The detonator receptacle 138 has an opening 514 that provides fluid communication between the detonator receptacle 138 and the shaped charge receptacle 130. The opening registers with the opening of the shaped charge 132. The detonator 140 initiates a ballistic discharge, which is communicated through the opening 514 and through the opening of the shaped charge 132 to activate the explosive material of the shaped charge 132.

Figure 6:
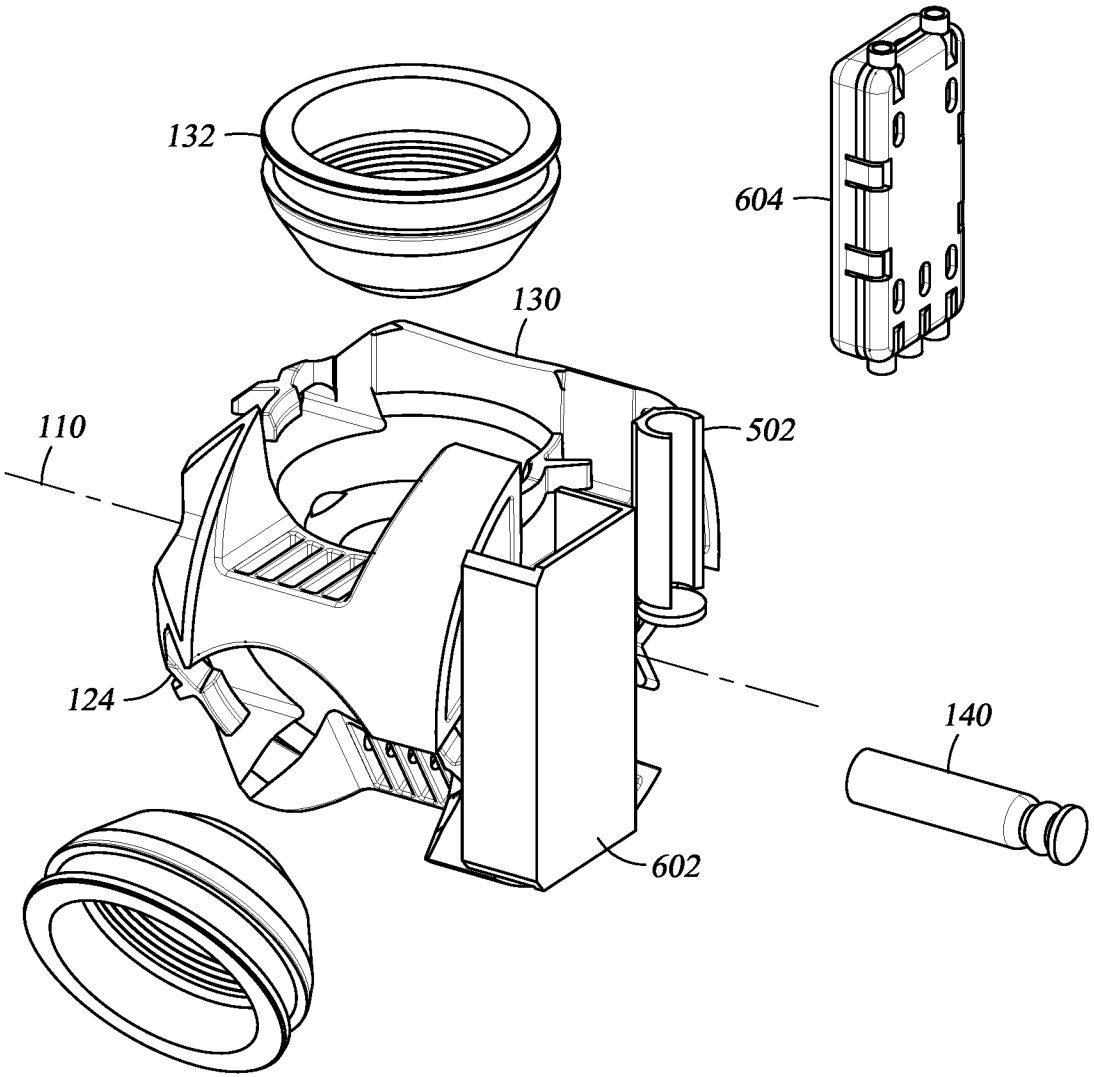
FIG. 6 is an exploded view of various components of the gun module of FIG. 1.

FIG. 6 is an exploded view of various components of the gun module 102 of FIG. 1. The frame 124 has multiple shaped charge receptacles 130 within which shaped charges 132 can be inserted. The frame 124 also includes the detonator transport receptacle 502 within which the detonator 140 is optionally stored for transportation. The multiple shaped charge receptacles 130 are arranged azimuthally with respect to the central axis 110, here in co-planar arrangement (i.e. arranged along a single plane transverse to the central axis 110), such that when the detonator 140 is inserted axially into the frame 124, the single detonator is capable of initiating each of the multiple shaped charges 132.

The frame 124 further includes a switch/controller module holder 602 configured to hold a switch/controller module 604 during use and/or transport. In an assembled state, the switch/controller module 604 is communicatively coupled with at least one of the detonator 140 or the conductive material 142 (FIG. 1), and configured to cause an electric current to be received by the detonator 140. In some embodiments, the switch/controller module 604 comprises a computer or processor-based system such as the computer or processor-based system 3000 (see FIG. 30). In some embodiments, the switch/controller module 604 comprises an addressable switch configured to be communicatively connected with a computer or processor-based system such as the computer or processor-based system 3000.

The switch/controller module 604, in this case, is an electronic component with wireless connections. The holder 602 can be configured with connections that can connect with the wireless connections of the module 604, or wires or plugs can be connected into the wireless connections to connect the module 604 with the gun module 102 and then the module 604 can be disposed in the holder 602. The holder 602 can be a box that loosely holds or accommodates the module 604, or the holder 602 can have a shaped interior that matches and engages with an outer shape of the module 604 to "hold" the module 604 securely.

Figure 7:
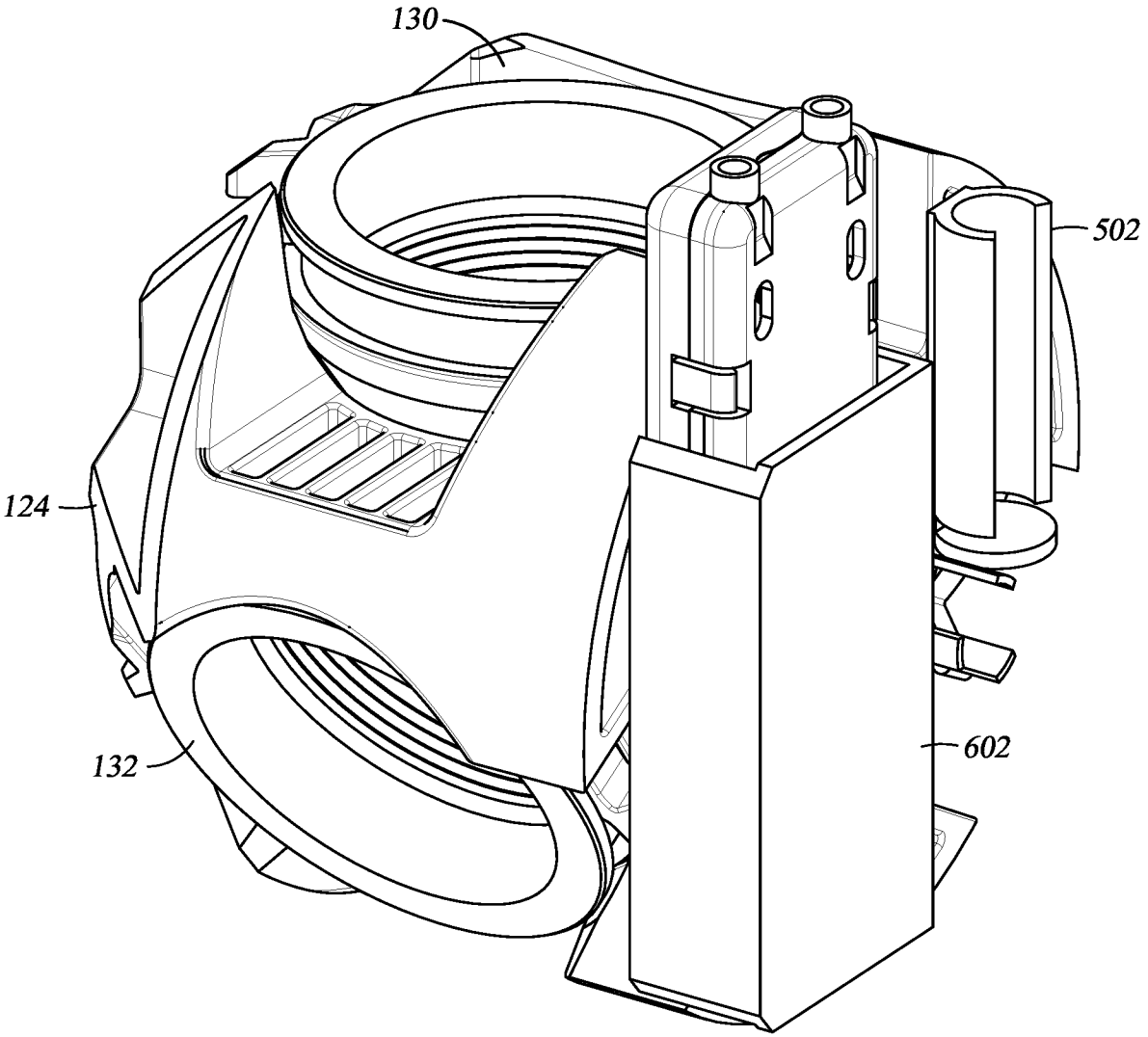
FIG. 7 is an assembled view of the various components of the gun module of FIG. 6.

FIG. 7 is an assembled view of the various components of the gun module 102 of FIG. 6. The assembly in FIG. 7 has the shaped charges 132 inserted into the shaped charge receptacles 130 of the frame 124. The detonator transport receptacle 502 is empty, and the switch/controller module 604 is at least partially inserted into switch/controller module holder 602. The assembly in FIG. 7 has all the electronics and ballistics in a single package.

In this case, both the holder 602 and the detonator transport receptacle 502 are located at the second end 128 of the frame 124, with the detonator receptacle 138 accessible between the holder 602 and the receptacle 502. The holder 602 has a bottom, in this case, which is not visible in FIG. 7. The bottom of the holder 602 allows the module 604 to rest loosely in the holder 602. Where the holder 602 has internal geometry to closely fit, grip, or securely hold the module 604, the holder 602 could have no bottom so that the module 604 could be inserted into the holder 602 from the top thereof or from the bottom. The detonator transport receptacle 502, in this case, is a cylindrical segment, that is, a cylinder with an arc segment removed. The detonator transport receptacle 502 also has a bottom to provide a stop at one end of the receptacle 502. Thus, the detonator is inserted into the receptacle 502 from the top and is extended into the receptacle until contact is made with the bottom. The receptacle 502 can thus hold the detonator securely around a portion of the circumference of the detonator, and also supports the detonator at one end thereof. Like the holder 602, if the receptacle 502 is configured to securely hold the detonator around the portion of the circumference of the detonator, potentially using convenient ridges, tabs, grooves, and the like, the bottom of the receptacle 502 could be omitted and the receptacle 502 would be like a clip that holds the detonator.

It should also be noted that the detonator transport receptacle 502 can be located at an end opposite from the holder 602. For example, the detonator transport receptacle 502 could be located at the first end 126 of the frame 124, while the holder 602 is located at the second end 128. In such cases, there is more flexibility for locating the detonator transport receptacle 502 at a wider variety of locations along the first end 126. It should also be noted that the detonator transport receptacle 502 and the holder 602 are in parallel orientations, but if the detonator transport receptacle 502 is located at an end of the frame 124 opposite from the holder 602, the receptacle 502 and the holder 602 could be in any relative orientations. Regarding orientation, the holder 602 is shown here as a rectangular box with a wide side and a narrow side, and the holder 602 is oriented with the wide side facing the first end 126 of the frame 124 to minimize axial dimension of the frame 124 within the gun module 102.

Figure 8:
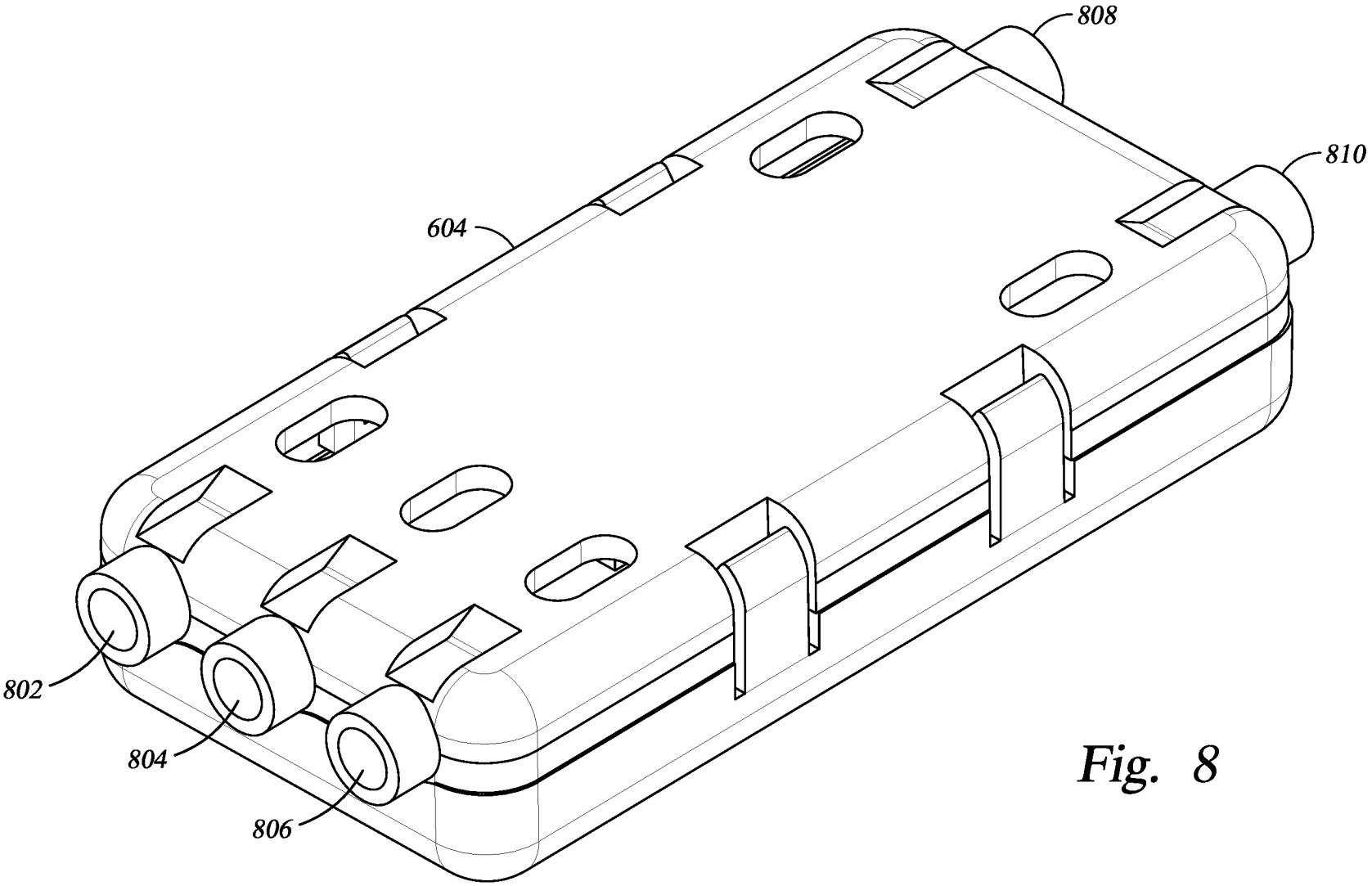
FIG. 8 is a diagram of a switch/controller module according to one embodiment.

FIG. 8 is a diagram of the switch/controller module 604 according to one embodiment. In this example embodiment, the switch/controller module 604 is an addressable switch. There are five wire connections to the switch/controller module 604, an uphole communication connection 802 to an uphole gun, a downhole communication connection 804 to a downhole gun, an electrical ground connection 806, a first detonator communication connection 808, and a second detonator communication connection 810. In an assembled state, the first detonator communication connection 808 and the second detonator communication connection 810 are connected to a single detonator 140. In some embodiments, in an assembled state, the first detonator communication connection 808 and the second detonator communication connection 810 are directly connected to a single detonator 140 by way of corresponding wires. The uphole communication connection 802, the downhole communication connection 804, and the electrical ground connection 806 can be connected to the conductive material 142 (see FIG. 1) of adjacent gun modules 102 (see FIG. 1), while the ground is typically connected to the housing 104. In some embodiments, the communication and ground connections are connected to the conductive material 142, the detonator 140 (see FIG. 1), or the housing 104 by way of corresponding RCA connectors, spring contacts, or other suitable electrical connection. In some embodiments, in an assembled state, the uphole communication connection 802 is electrically connected to the first electrical contact 134 (see FIG. 1), and the downhole communication connection 804 is electrically connected to the second electrical contact 136 (see FIG. 1). In some embodiments, the switch/controller module 604 is configured to have greater or fewer wire connections to facilitate electrical communication between the switch/controller module 604 and one or more components of a gun module that includes or is in communication with the switch/controller module 604. The switch/controller module 604, as such, has no permanently connected wires external to the module 604. The module 604 can be electrically connected by inserting wires into the various connections 802, 804, 806, 808, and 810, or by providing connector prongs to insert into the connections, for example by forcing the module 604 onto appropriately configured connector prongs. Such prongs may be provided and configured in the switch/controller module holder 602 shown in FIG. 7, for example.

Figure 9:
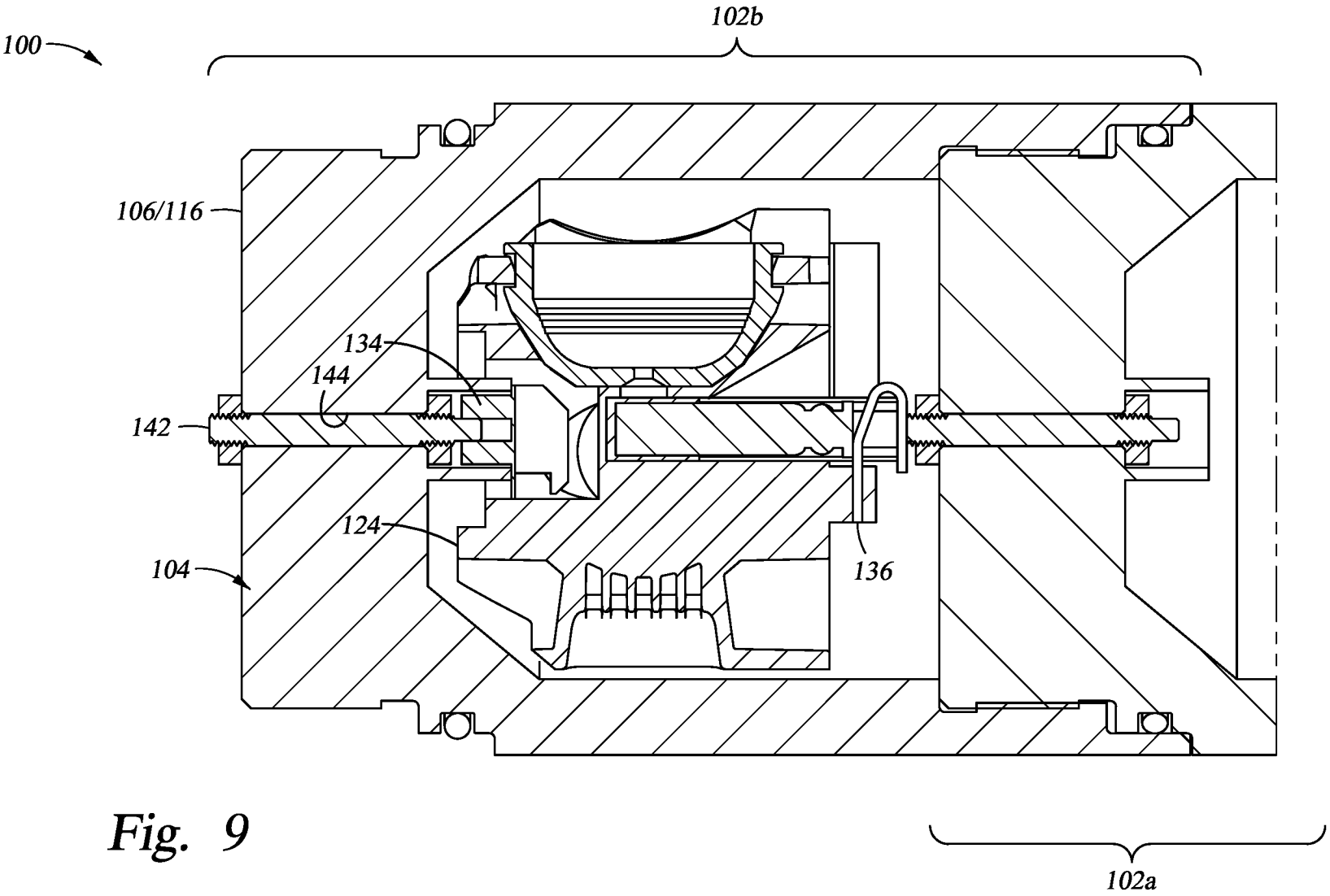
FIG. 9 is a cross-sectional view of a portion of the perforation tool of FIG. 1.

FIG. 9 is a cross-sectional view of a portion of the perforation tool 100 of FIG. 1. In this example embodiment, the conductive material 142 and the first electrical contact 134 of the frame 124 included in the gun module 102*b* utilize an RCA connection to couple the uphole line using the via 144, and to couple the ground to the housing 104. In this case, the second electrical contact 136 is a spring contact that transmits telemetry to the gun module 102*a*, which is the downhole gun from the gun module 102*b*.

Figure 10:
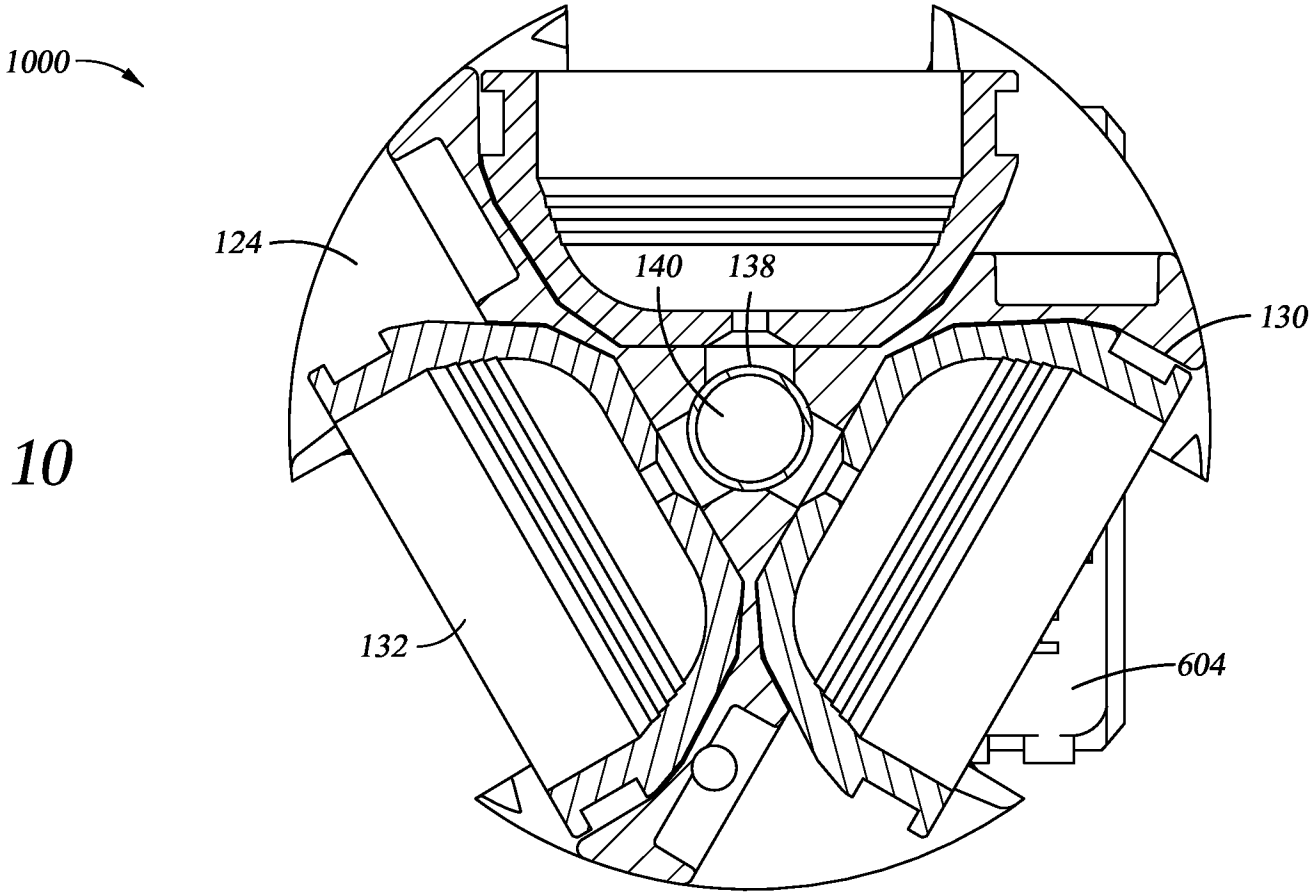
FIG. 10 is an end view of an assembly package from a first end thereof according to one embodiment.
Figure 11:
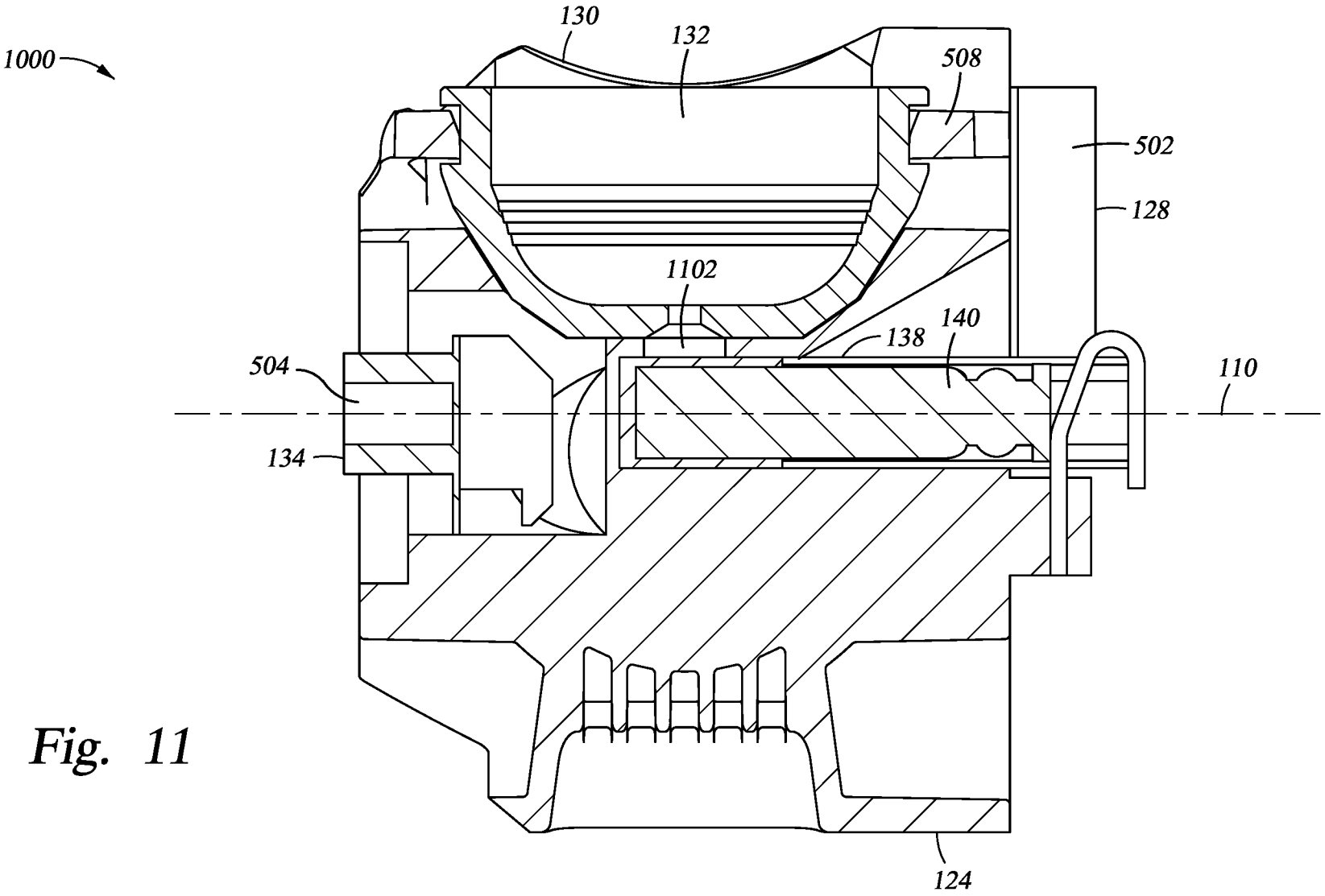
FIG. 11 is a cross-sectional view of the assembly package of FIG. 10.

FIG. 10 is an end view of an assembly package 1000 from a first end thereof, according to one embodiment. FIG. 11 is a cross-sectional view of the assembly package 1000. The assembly package 1000 includes a frame 124 having three shaped charge receptacles 130 with a corresponding quantity of shaped charges 132 accommodated therein (the explosive material of the shaped charges is omitted for illustration purposes). The assembly package 1000 also includes the detonator 140 within the detonator receptacle 138, and the switch/controller module 604. In use, the switch/controller module 604 sends an electric current to the detonator 140. The detonator 140 discharges, sending ballistic discharge through the radial openings formed in an exterior wall of the detonator receptacle 138 and causing the surrounding, azimuthally-arranged shaped charges 132 to discharge. When operatively inserted into the detonator receptacle 138, a portion of the detonator 140 is adjacent to an opening 1102 adjacent to a distal end of the detonator receptacle 138 that provides fluid communication from the receptacle 138 into the shaped charge receptacle 130 for ballistic transfer from the detonator 140 to the explosive material of the shaped charge 132. The assembly package 1000 includes the same configuration of electrical connections as that discussed in connection with FIG. 5. The description is accordingly not repeated for brevity.

Figure 12:
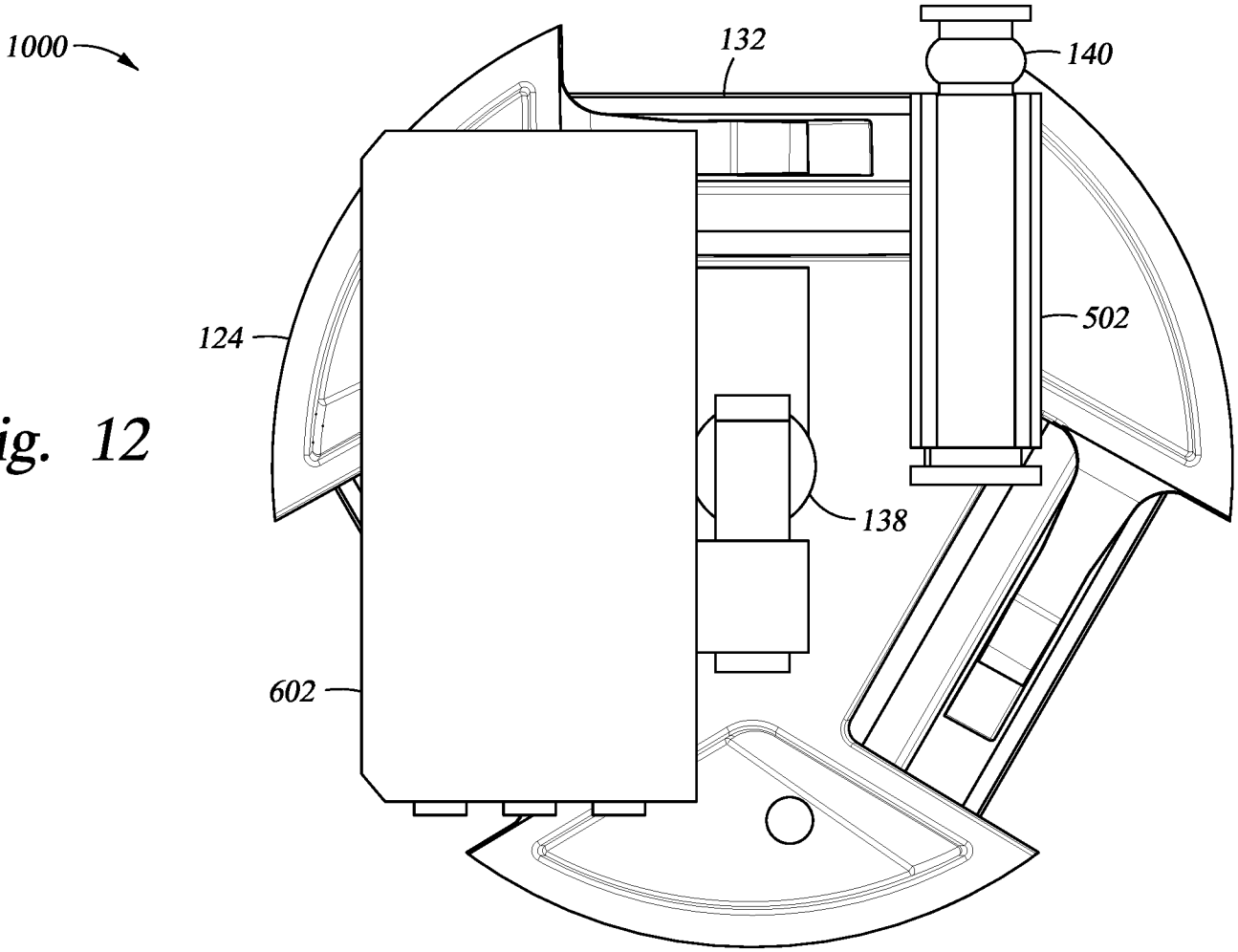
FIG. 12 is an end view of the assembly package of FIG. 10 from a second end, opposite from the first end.

FIG. 12 is an end view of the assembly package 1000 from a second end thereof, opposite from the first end, according to one embodiment. Safety regulations for transporting shaped charges and detonators limit how perforating tools, components thereof, including explosives, may safely be shipped together in an unarmed state. For example, the shaped charges 132 can be pre-installed in the frame 124. The detonator 140 can also be installed into the detonator transport receptacle 502 and transported in an unarmed "transport" position. At the field location, the user can then move the detonator 140 from the "transport" position, into the axial armed position as a string of gun modules 102 (see FIG. 1), or gunstring, which makes up the perforating tool 100 (FIG. 1) is being built. In this configuration of the assembly package 1000, the wires to the detonator 140 are pre-installed into the switch (not shown, but positioned within switch/controller module holder 602) during transportation. At the field location, the user removes the detonator 140 from the detonator transport receptacle 502 and inserts the detonator 140 into the axial detonator receptacle 138 of the frame 124.

In some embodiments, the shaped charges 132 can be pre-installed in the frame 124 and the detonator 140 is later wired into the switch/controller module 604 (see FIG. 6) at the field location such that the detonator 140 is installed into the module as the gun string is being built. In some embodiments, the detonator 140 can be pre-installed in the frame 124 and the shaped charges 132 are then installed at the wellsite as the gun string is being built.

Figure 13:
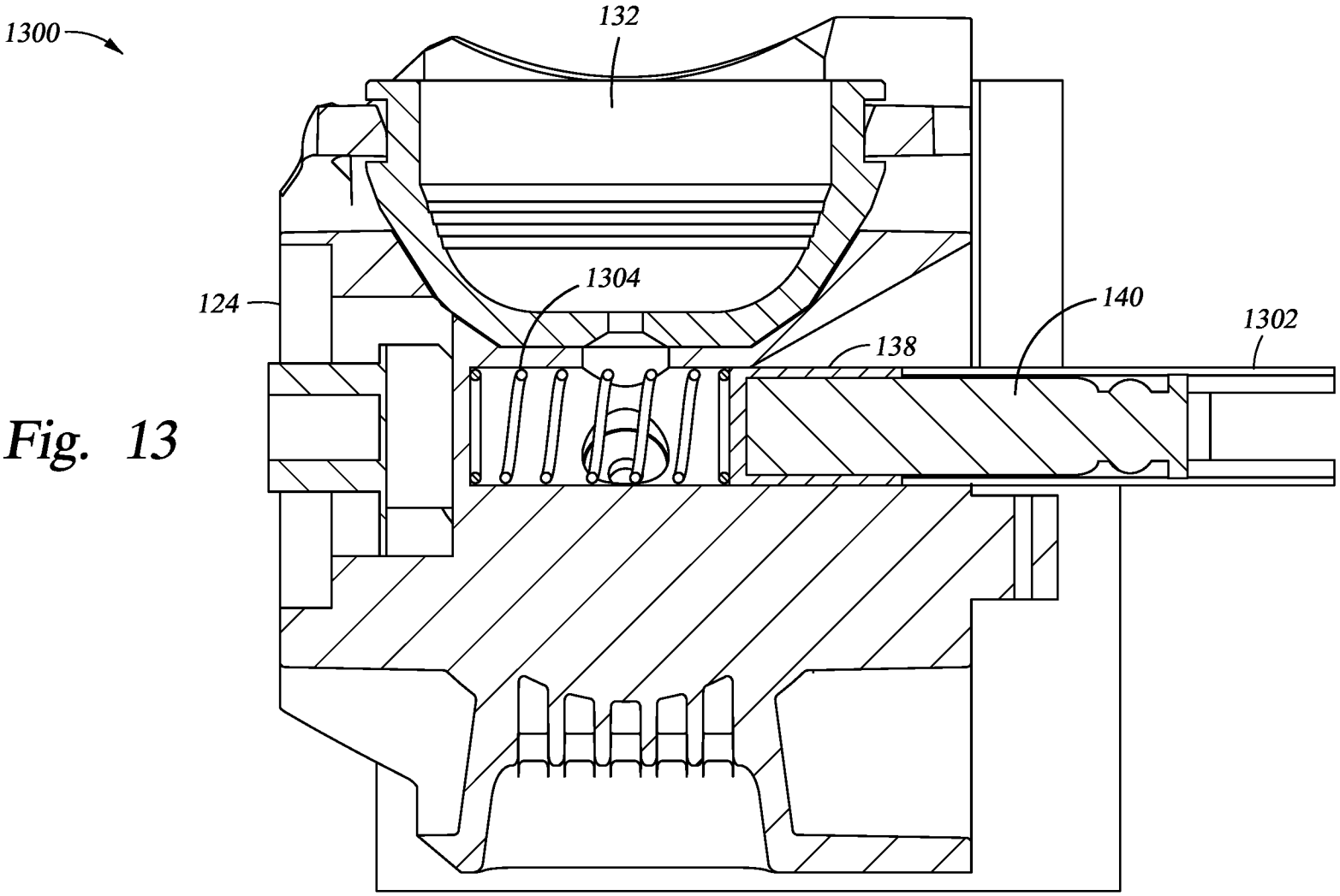
FIG. 13 is a cross-sectional view of an assembly package according to another embodiment.

FIG. 13 is a cross-sectional view of an assembly package 1300 according to another embodiment. Here, a safety sleeve 1302 surrounds the detonator 140 and prevents the detonator 140 from initiating the shaped charges 132. The safety sleeve 1302 is capable of being removed so that the detonator 140 can be easily installed into the armed state. In some embodiments, all of the shaped charges 132 and the detonator 140 can be pre-installed in the frame 124 in a partially armed state based on the position of the safety sleeve 1302, which prevents ballistic transfer until the next downhole housing 104 of a next gun module 102 is attached to the partially armed assembly package 1300, depressing a spring 1304, and thus moving the safety sleeve 1302 into registration with the shaped charges 132 through the radial openings in the detonator receptacle 138. The safety sleeve 1302 may have one or more openings formed therein to register with the radial openings of the detonator receptacle 138, or the safety sleeve 1302 may be made thin enough that discharge of the detonator 140 pierces through the safety sleeve 1302 to engage the shaped charges 132. In some embodiments, the detonator 140 is stationary within the detonator receptacle 138 and the safety sleeve 1302 is movable within the detonator receptacle such that when a next gun module 102 is attached, the safety sleeve 1302 is caused to move based on an attachment of the next gun module 102, and the one or more openings in the safety sleeve 1302 are brought into alignment with the radial openings of the detonator receptacle 138 to facilitate fluid communication between the detonator 140 and the shaped charges 132. In some embodiments, the safety sleeve 1302 is caused to move in the axial direction based on the attachment of the next gun module 102 to cause the one or more openings in the safety sleeve 1302 to align with the radial openings of the detonator receptacle 138. In some embodiments, the safety sleeve 1302 is caused to rotate about the central axis based on the attachment of the next gun module 102 to cause the one or more openings in the safety sleeve 1302 to align with the radial openings of the detonator receptacle 138. In some embodiments, the safety sleeve 1302 comprises a material and/or has a thickness that is capable of resisting penetration by ballistic discharge of the detonator 140 to prevent incidental ignition of the shaped charge 132 in an unarmed and/or unassembled state. In some embodiments, the safety sleeve 1302 is dynamic such that in an unassembled state, the detonator 140 is isolated from the shaped charges by safety sleeve 1302 and, as the gun modules 102 are attached to one another, the frame 124 becomes electrically connected to the next gun module 102, and the detonator 140 is then ballistically connected to the shaped charges 132.

The safety sleeve 1302 is shown in FIG. 13 extending substantially the entire length of the detonator 140. In other examples, the safety sleeve 1302 could have a length less than a length of the detonator 140, so that the safety sleeve 1302 extends only partway along the length of the detonator 140. In such cases, the safety sleeve 1302 has length sufficient to block fluid communication between the detonator receptacle 138 and the charge receptacle 130 through the opening 1102. The safety sleeve 1302 extends around the entire circumference of the detonator 140, but in alternate cases, the safety sleeve 1302 may extend only partway around the circumference of the detonator 140, and/or may have gaps to reduce the material included in the safety sleeve 1302. In such cases, the safety sleeve 1302 will have a structure that can engage with the detonator 140 to remain securely positioned, where a portion of the safety sleeve 1302 blocks the opening 1102 to prevent ballistic transfer until the safety sleeve 1302 is removed or other neutralized as described herein.

Figure 14:
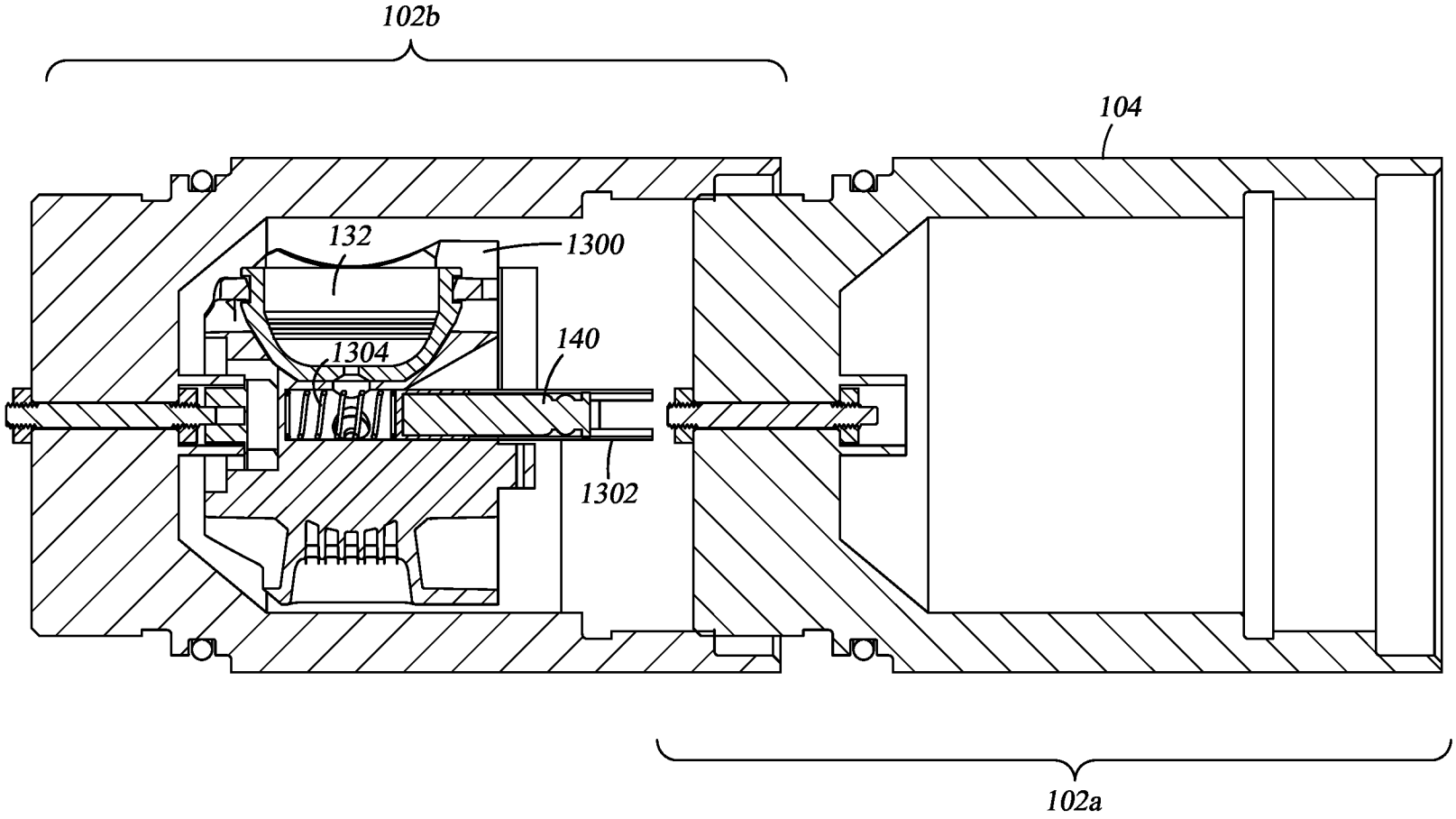
FIG. 14 is a cross-sectional view of a gun module having the assembly package of FIG. 13 in an unarmed state according to one embodiment.

FIG. 14 is a cross-sectional view of a gun module 102 having the assembly package 1300 of FIG. 13 in an unarmed state according to one embodiment. In FIG. 14, as the downhole housing 104 of the gun module 102*a* is partially screwed or inserted into the uphole gun module 102*b*. In this state, the safety sleeve 1302 touches the housing 104 (and thus also acts as an electrical ground) of the gun module 102*a*. To move the gun modules 102*a* and 102*b* to an armed state, the gun module 102*a* is completely engaged with (screwed into) the gun module 102*b*, and the spring 1304 is compressed, allowing the detonator 140 to move into an armed state in registration with, and ready to initiate, the shaped charges 132. This embodiment makes it possible to connect the explosives electrically before establishing a ballistic connection. The safety sleeve 1302 here can be a cylindrical component, where the portion extending beyond the detonator 140 to engage with the housing 104 of the gun module 102*a* has a circular cross-section. Alternately, the safety sleeve 1302 could be a shorter cylindrical component, where the portion extending beyond the detonator 140 is one or more prongs that engage with the housing 104 of the gun module 102*a*.

Figure 15:
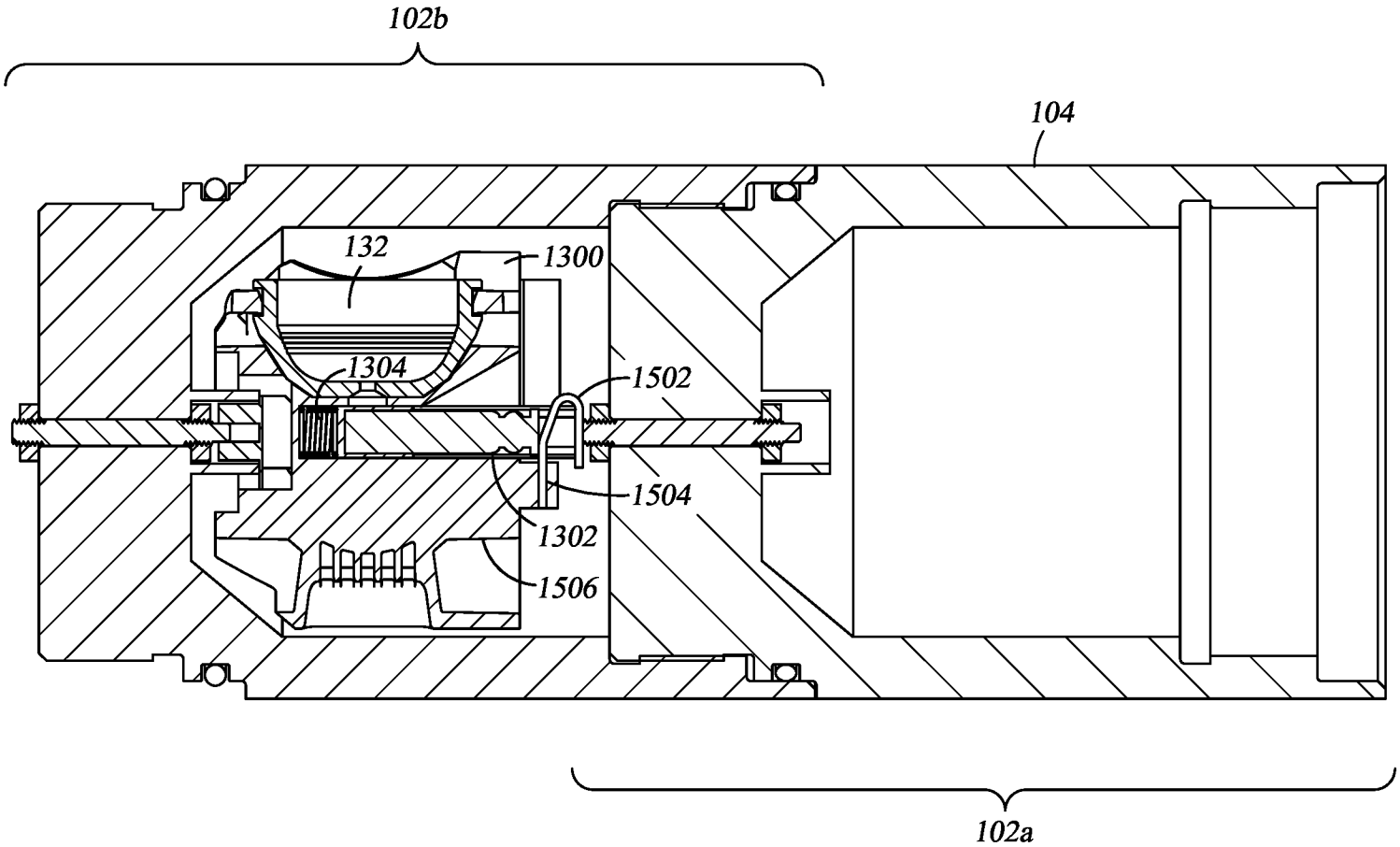
FIG. 15 a cross-sectional view of the gun module of FIG. 14 in the armed state.

FIG. 15 a cross-sectional view of the gun module 102 having the assembly package 1300 of FIG. 14 in an armed state according to one embodiment. In FIG. 15, the downhole housing 104 of the gun module 102*a* is completely engaged with the uphole gun module 102*b*, the safety sleeve 1302 touches the housing 104 (also acting as an electrical ground as above), and the spring 1304 is compressed. The safety sleeve 1302 is in an engagement position with the shaped charges 132, and the detonator 140 is in the armed state, ready to initiate the shaped charges 132. In this position, the conductive material 142 of the gun module 102*a* is fully engaged and connected with the second electrical contact 136 of the uphole gun module 102*b* to provide electrical continuity between the gun modules 102*a* and 102*b*. The gun modules 102*a* and 102*b*, with the frame 124 and its electrical and ballistic continuity structure, are and make electrical connection merely by connecting the two gun modules 102*a* and 102*b* together.

In FIG. 15, electrical contact between the gun modules 102*a* and 102*b* is provided by a resilient electrical connector 1502 that is captured in a slot 1504 of the frame 1506 of the assembly package 1300. The resilient electrical connector 1502 is able to flex in an axial direction of the perforation tool of FIG. 15. Engagement of the gun module 102*a* with the gun module 102*b* makes contact between the electrical connector 1502 and the conductive material of the gun module 102*a*, providing electrical feedthrough between the gun modules 102*a* and 102*b*. As the gun module 102*a* is fully engaged with the gun module 102*b*, the resilient electrical connector 1502 is flexed toward the detonator, urging the detonator toward the spring 1304 to compress the spring 1304, bringing the detonator into full engagement position with the shaped charges 132. Although the resilient electrical connector 1502 is positioned to hold the detonator within the detonator receptacle against the spring 1304, the resilient electrical connector 1502 is flexible enough to allow the detonator to move out of ballistic engagement with the shaped charges 132.

The detonator, with safety sleeve 1302, is installed in the receptacle by removing the connector 1502 from the slot 1504, sliding the detonator into the receptacle, depressing the detonator against the spring 1304 to expose the slot 1504, and then installing the connector 1502 into the slot 1504. The slot 1504 is located adjacent to the open end of the detonator receptacle so that when the detonator is disposed in the detonator receptacle, the connector 1502 holds the detonator securely within the detonator receptacle. The connector 1502 and the spring 1304 capture and hold the detonator in the receptacle. Then, engaging the gun module 102*a* with the gun module 102*b* compresses the connector 1502 against the detonator, compressing the spring 1304 to bring the detonator to an armed position.

Figure 16:
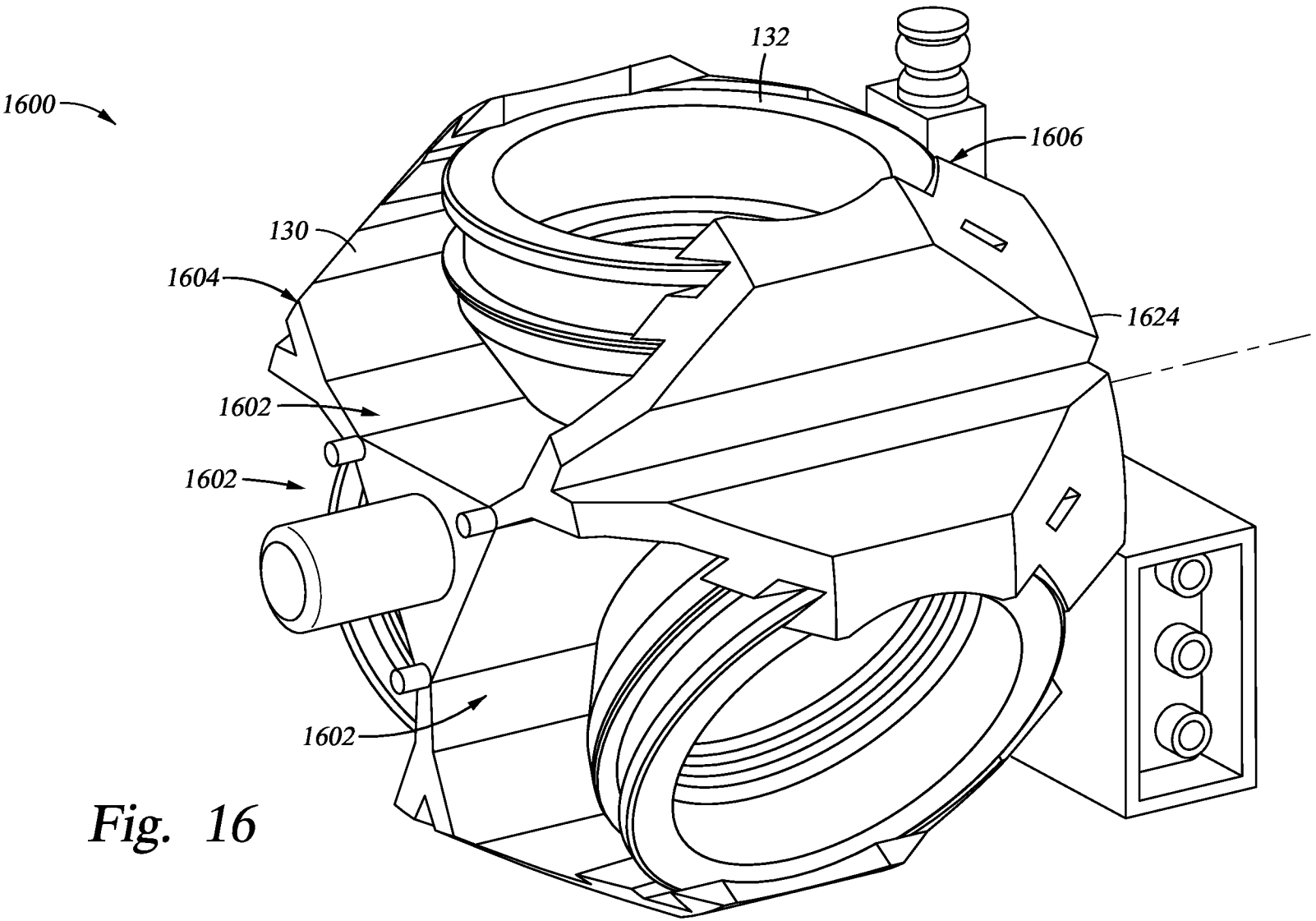
FIG. 16 is a perspective view of an assembly package according to one embodiment.

FIG. 16 is a perspective view of an assembly package 1600 according to another embodiment. In this example, the shaped charges 132 are installed and positioned in shaped charge receptacles 130 using slide-in positioning features. The assembly package 1600 uses a frame 1624 that has a plurality of tracks 1602 for inserting and removing shaped charges 132 (and spent charge casings). Each track 1602 has an open end 1604 and a closed end 1606. A shaped charge 132 is inserted at the open end 1604 of the track 1602 and is moved along the track 1602 in an axial direction to abut the closed end 1606 of the track 1602. Each track 1602 has walls extending outward in a quasi-radial fashion to retain the shaped charge 132 in the track 1602 at the closed end 1606 thereof. In this case, the open end 1604 of each track 1602 is at the first end 126 of the frame 1624 and the closed end 1606 of each track 1602 is at the second end 128 of the frame 1624. Here, the switch/controller module holder 602 and the detonator transport receptacle 502 are located at the second end 128, as in other embodiments herein. In this case, however, the holder 602 and the detonator transport receptacle 502 are in intersecting orientations to illustrate optional relative positioning and orientation of the holder 602 and the receptacle 502. It should be noted that, using this frame, the receptacle 502 and the holder 602 are most effectively located at the second end 128 to avoid occluding the open ends 1604 of the tracks 1602.

Figure 17:
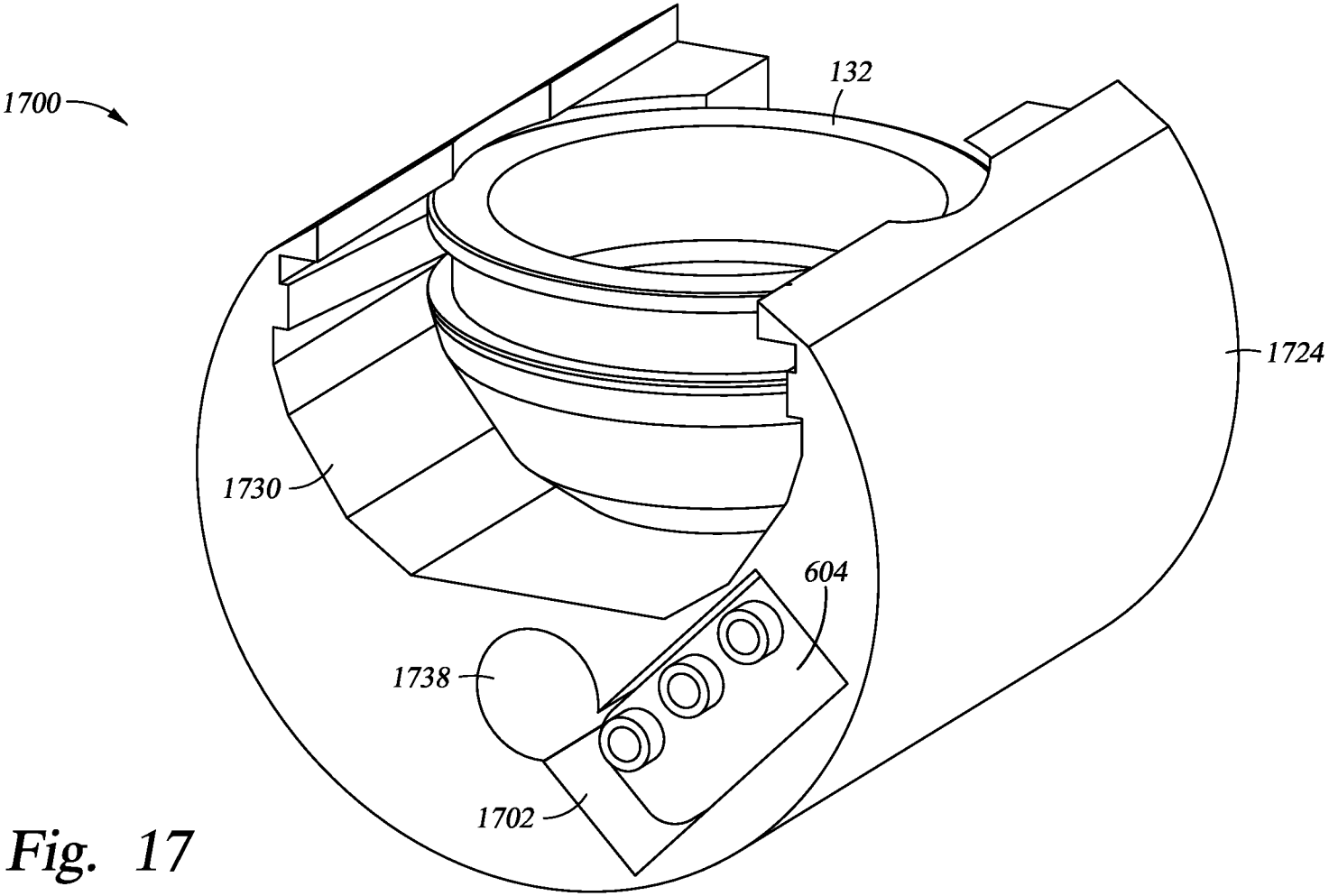
FIG. 17 is a perspective view of an assembly package according to one embodiment.

FIG. 17 is a perspective view of an assembly package 1700 according to another embodiment. The assembly package 1700 is similar to the assembly package 1000 and includes a frame 1724. The frame 1724 is similar to the frame 124 of FIG. 1, except that the frame 1724 is configured to accommodate a single shaped charge 132. This makes it possible for the outer diameter D1 of the housing 104 (see FIG. 1) to be minimized. The frame 1724 includes a switch/controller module holder 1702 configured to store the switch/controller module 604 inside the frame 1724, between a detonator receptacle 1738 and an exterior of the frame 1724, making it possible to minimize the length L1 of the housing 104 (see FIG. 1), since the frame 1724 does not have the extra length of an external switch/controller module holder. The charge receptacle 1730 can optionally be a slide in version, pop-in version, clip version, screw-in version, or other suitable manner or fastener.

The variations of oriented/non-oriented, number of charges, and type of charge allows for many different configurations to exist. Furthermore, owing to the various geometries of the frame, for example to accommodate greater or fewer quantities, positioning, or types of charges, the switch/controller module 604 can optionally be embedded inside of the frame 1724 in one or more different locations, making it possible to minimize the length of the housing and frame to be included in a gun module 102.

Figure 18:
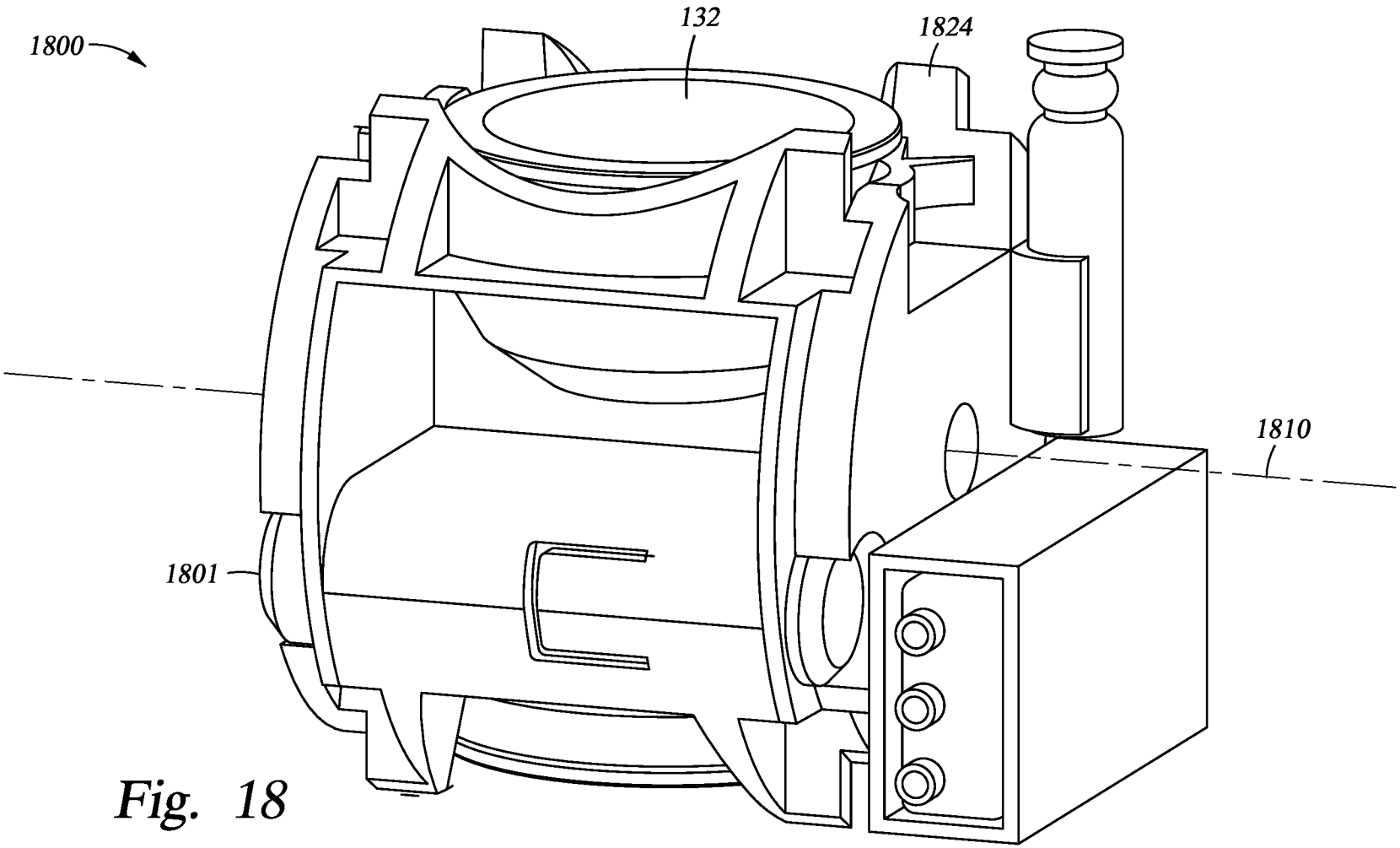
FIG. 18 is a perspective view of an assembly package according to one embodiment.

FIG. 18 is a perspective view of an assembly package 1800 according to another embodiment. In this case, the assembly package 1800 includes a frame 1824 that is similar to the frame 124 in many respects. The frame 1824 is configured to accommodate two shaped charges 132 and has a generally cylindrical form with a central axis 1810. The assembly package 1800 further includes one or more weights 1801 that are configured to change a center of mass of the assembly 1800 as compared to a situation in which the assembly 1800 is lacking the weights 1801, thus providing an increased moment of mass with respect to the central axis 1810. The assembly package 1800 is configured to be rotatable about the central axis 1810 within the housing 104 (see FIG. 1) in an assembled state. In some embodiments, the frame 1824 is self-orienting based on a center of mass of the assembly package 1800. The weights 1801 are removably installed into the frame 1824 to increase the moment of mass of the assembly package 1800, with respect to the central axis 1810, and to facilitate customized orientation directions based on a center of mass of the assembly package 1800 with or without the weights 1801 installed.

Figure 19:
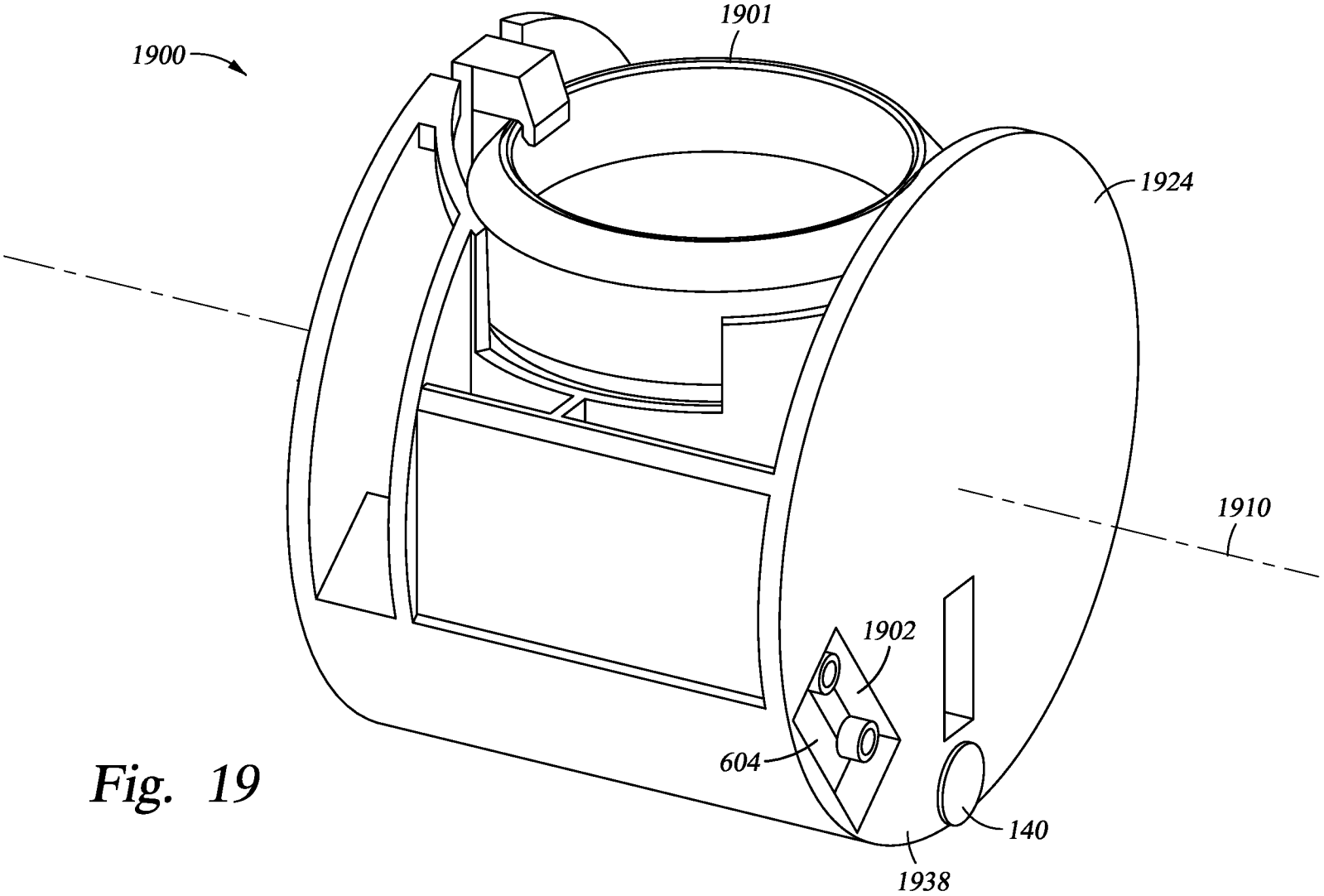
FIG. 19 is a perspective view of an assembly package according to one embodiment.

FIG. 19 is a perspective view of an assembly package 1900 according to one embodiment. The assembly package 1900 is similar to the assembly package 1700 (see FIG. 17) in many respects. The assembly package 1900 includes a frame 1924, which is similar to the frame 124 (FIG. 1), except that, in this case, the frame 1924 is configured to hold a single S-Charge 1901. The S-Charge 1901 is different from the shaped charges 132 in size. The frame 1924 configured to position the S-Charge 1901 such that the S-Charge 1901 extends across the central axis 1910 from one side of the frame 1924 to the opposite side, along a radius of the frame 1924. The detonator receptacle 1938, in this case, is located between the central axis 1910 and an exterior surface of the frame 1924, and between the charge receptacle of the frame 1924 and the exterior surface of the frame 1924 at the narrow end of the charge receptacle. The detonator 140 is in the detonator receptacle 1938 and configured to initiate the S-Charge 1901. The frame 1924 includes a switch/controller module holder 1902 that is configured to store the switch/controller module 604 in the frame 1924 between central axis 1910 and the exterior surface of the frame 1924 at a location azimuthally spaced apart from the location of the detonator receptacle 1938.

Figure 20:
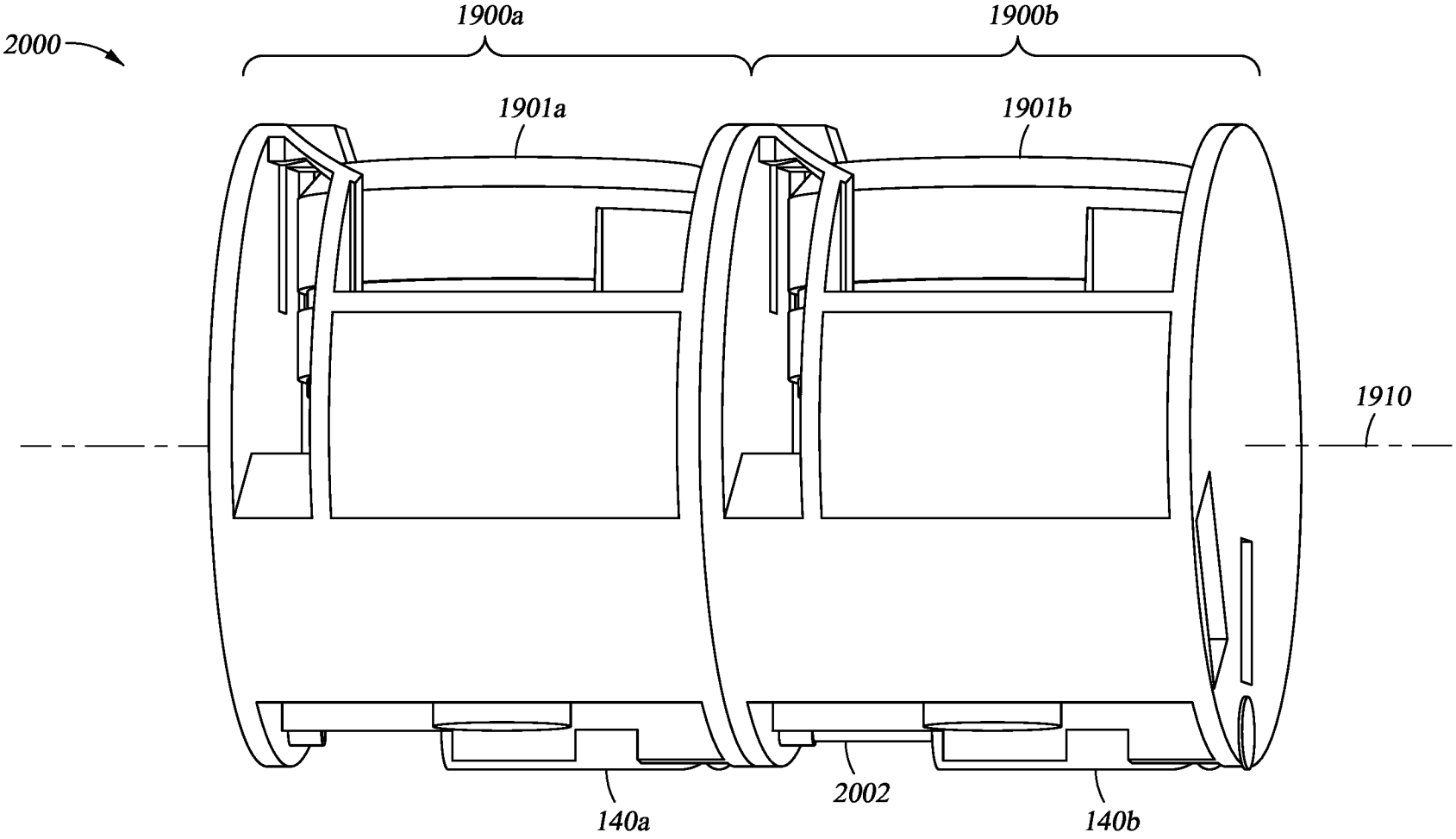
FIG. 20 is a perspective view of an assembly package according to one embodiment.

FIG. 20 is a perspective view of an assembly package 2000 according to another embodiment. The assembly package 2000 comprises two assembly packages 1900 (see FIG. 19), a first assembly package 1900*a* and a second assembly package 1900*b*. In assembly package 2000, each of the first assembly package 1900*a* and the second assembly package 1900*b* holds a corresponding S-Charge 1901*a* or 1901*b* and a corresponding detonator 140*a* or 140*b*. The assembly package 2000 includes a booster/detonator cord 2002 configured to be initiated by whichever of the detonator 140*a* or the detonator 140*b* is detonated first to cause the other of the detonator 140*a* or the detonator 140*b* to be initiated and accordingly detonate the corresponding S-Charge 1901*a* or 1901*b*.

The assembly package 2000 is shown with the first assembly package 1900*a* and the second assembly package 1900*b* phased at 0 degree (i.e., the S-Charges 1901*a* and 1901*b* face the same direction with respect to the central axis 1910). In some embodiments, the assembly packages 1900*a* and 1900*b*, or any additional quantity of the assembly packages 1900 are optionally combined and arranged to such that the corresponding S-Charges face any number of directions for form assembly package 2000. For example, if three of the assembly packages 1900 are coupled together, each of the assembly packages 1900 may be arranged at 120 degree variations from one another. If four of the assembly packages 1900 are coupled together, each of the assembly packages 1900 may be arranged at 90 degree variations from one another. In some embodiments, all of the assembly packages 1900 for any quantity of the assembly packages 1900 may be arranged to be in the same orientation. In some embodiments, at least one of the assembly packages 1900 for any quantity of the assembly packages 1900 may be arranged in a different orientation from one or more of the other assembly packages 1900 included in a combination of the assembly packages 1900.

Figure 21:
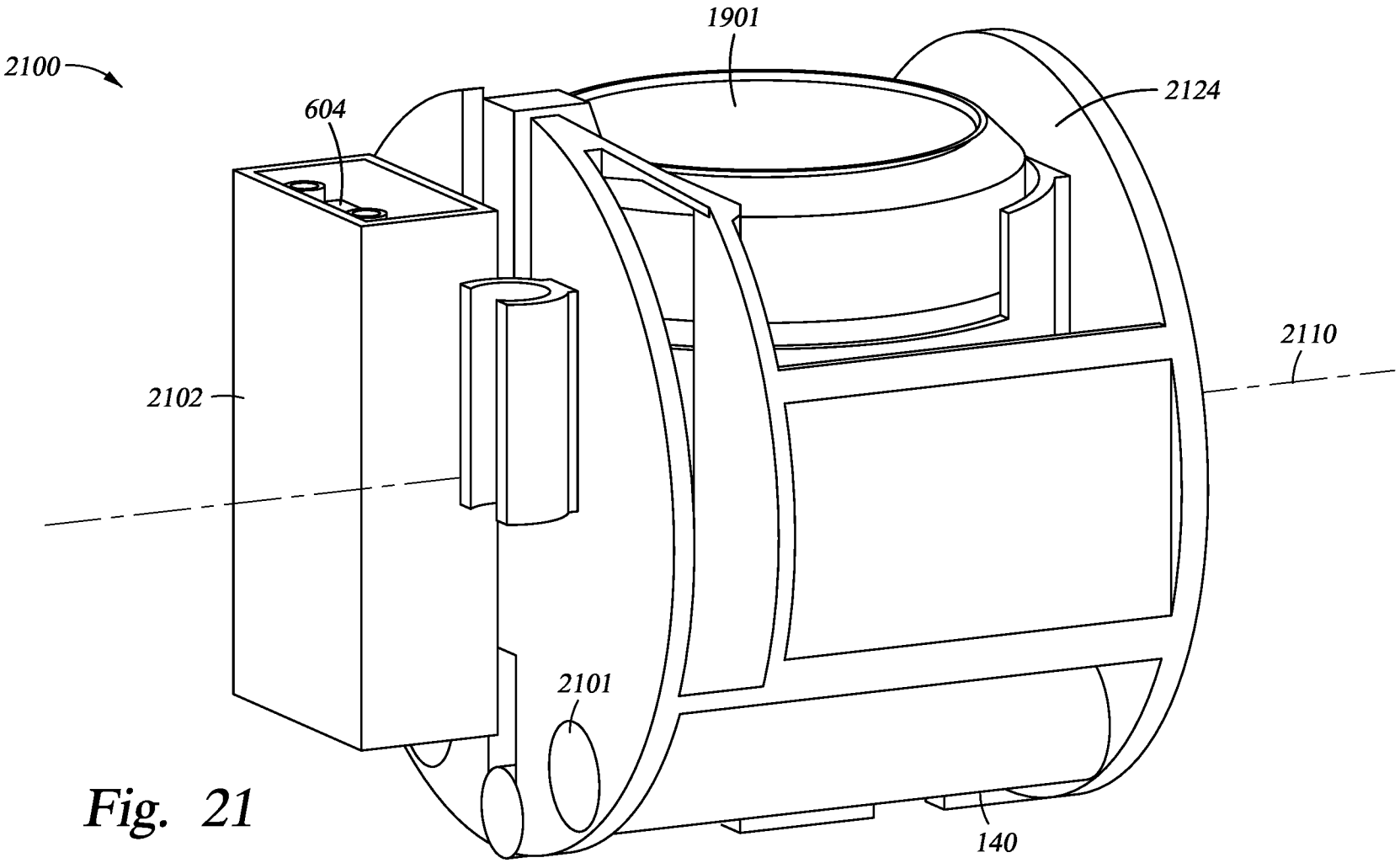
FIG. 21 is a perspective view of an assembly package according to one embodiment.

FIG. 21 is a perspective view of an assembly package 2100 according to another embodiment. The assembly package 2100 is similar to the assembly package 1900 (see FIG. 19) in many respects, and like the assembly package 1900 is configured to hold a single S-Charge 1901. The assembly package 2100 includes a frame 2124, which is similar to the frame 1924 (see FIG. 19), but has an external switch/controller module holder 2102 configured to store the switch/controller module 604 at an exterior end surface of frame 2124. Weights 2101 are added between the central axis 2110 and an exterior surface of the frame 2124 to facilitate adjusting the orientation of assembly package 2100 when the assembly package 2100 is included in a gun module.

In some embodiments, the housing 104 (see FIG. 1) is configured to accommodate any quantity of the assembly packages 1900, 2000 or 2100, for example, to accommodate a greater quantity of the S-Charges 1901 in a gun module. For example, this would allow for gun modules 102 having two, three, four, or more of the S-Charges 1901 at identical, 180 degree, 120 degree, 90 degree, or any customizable degree of phasing, while still minimizing a length L1 of the housing 104 for a given quantity of the S-Charges 1901 as compared to a conventional perforation tool having a same quantity of S-Charges 1901.

Figure 22:
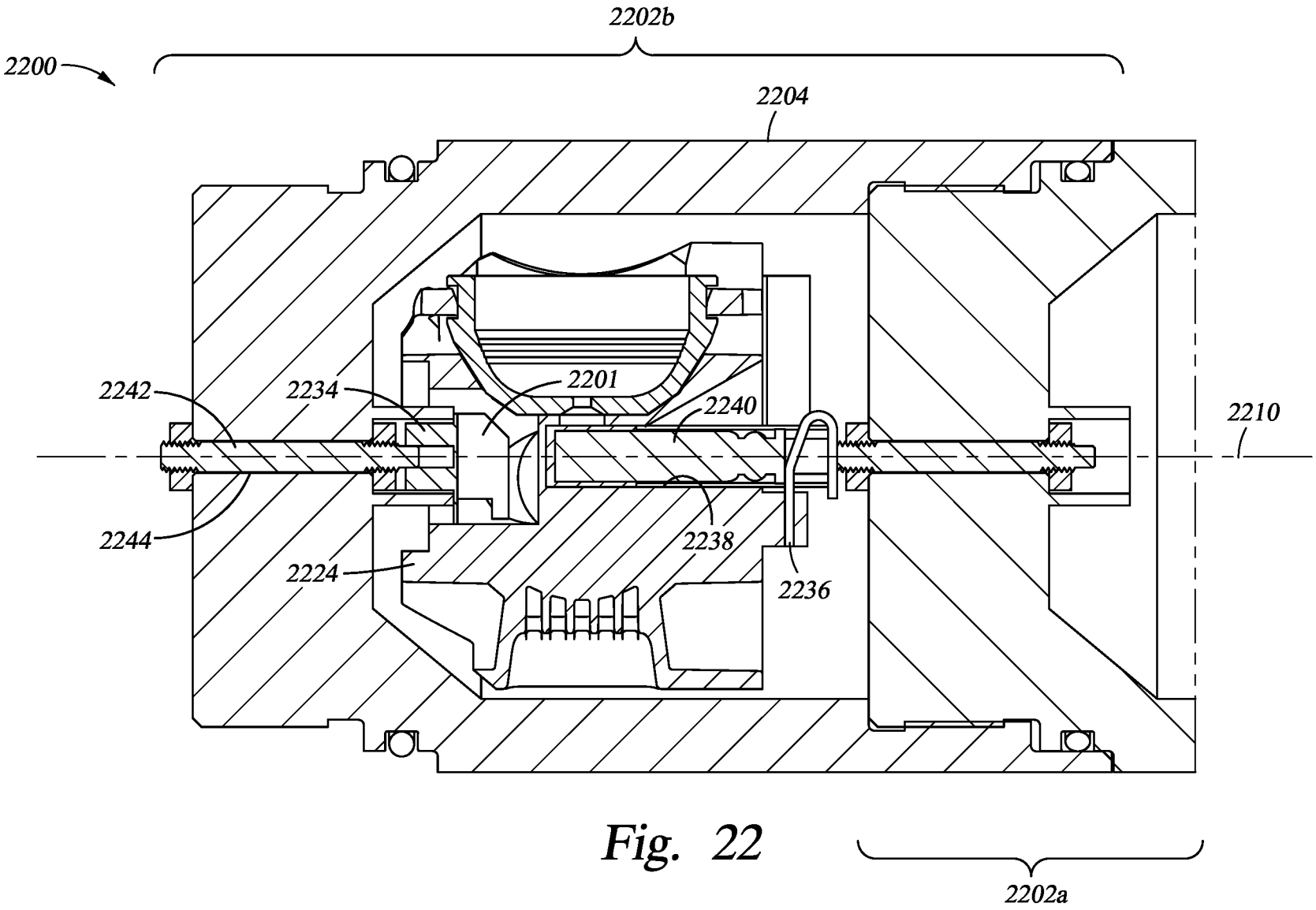
FIG. 22 is a cross-sectional view of a portion of a perforation tool according to one embodiment.

FIG. 22 is a cross-sectional view of a portion of a perforation tool 2200 according to one embodiment. The perforation tool 2200 is similar to the perforation tool 100 (FIG. 1), except that in this case, the conductive material 2242 and the first electrical contact 2234 of the frame 2224 included in the gun module 2202*b* utilize an RCA connection to couple the uphole line by way of the via 2244 and the ground to the housing 2204. The first electrical contact 2234 includes a ground portion 2201 configured to be connected directly or indirectly to a ground wire. In some embodiments, the ground portion 2201 is directly or indirectly electrically connected to the housing 2204. The second electrical contact 2236 is a spring contact that transmits telemetry to a gun module 2202*a*, which is the downhole gun from gun module 2202*b*. The perforation tool 2200 has a detonator 2240 disposed in a detonator receptacle 2238, which is similar to the detonator receptacle 138 of the perforation tool 100 (FIG. 1). The detonator 2240 and the conductive material 2242 of each gun module 2202*a* and 2202*b* are disposed along a central axis 2210 of the perforation tool 2200, with the second electrical contact 2236 providing a resilient electrical connection between the gun modules 2202*a* and 2202*b*.

The first electrical contact 2234 can be a spring contact while the second electrical contact 2236 is an RCA-type connection receptacle. Alternately, both the first electrical contact 2234 and the second electrical contact 2236 can be RCA-type connection receptacles, or both the first electrical contact 2234 and the second electrical contact 2236 can be spring contacts. In other cases, one or more of the first electrical contact 2234 or the second electrical contact 2236 can be another suitable type of electrically conductive material configured to facilitate an electrical connection or feedthrough that electrically couples two or more of the gun modules 2202.

In some embodiments, two or more assembly packages included in the gun modules 2202 are configured to be electrically connected to the gunstring included in the perforation tool 2200 by way of at least one electrical connection to the uphole feedthrough, at least one electrical connection to the downhole feedthrough, and at least one electrical connection to anywhere on the housing 2204.

The electrical connections discussed with respect to FIG. 22 are also usable for embodiments in which the frame 2224 is replaced by a frame configured to hold one or more S-Charges such as those discussed with respect to FIGS. 19-21.

Figure 23:
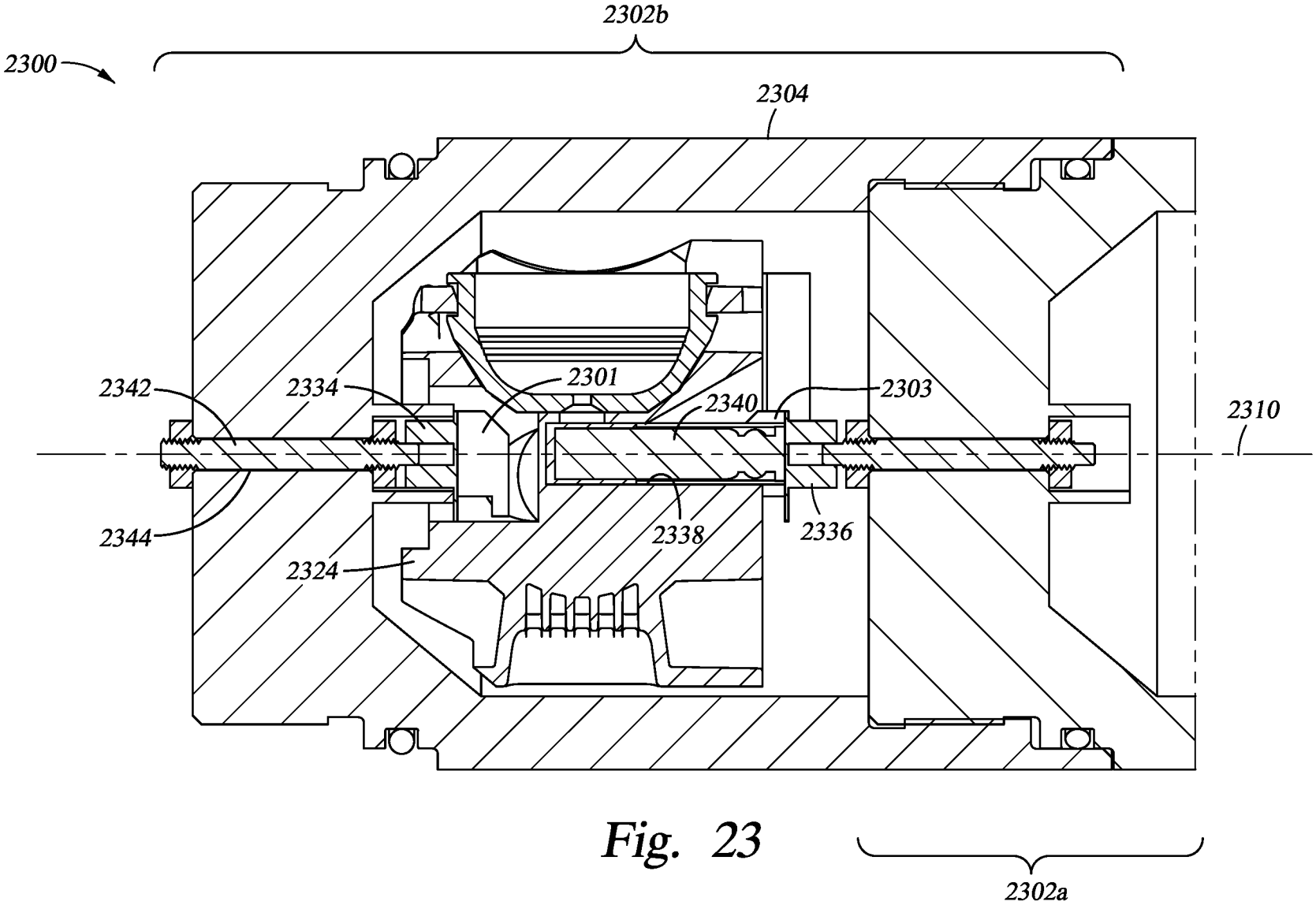
FIG. 23 is a cross-sectional view of a portion of a perforation tool according to one embodiment.

FIG. 23 is a cross-sectional view of a portion of a perforation tool 2300 according to one embodiment. The perforation tool 2300 is similar to the perforation tool 100 (FIG. 1), except in this case the conductive material 2342 and the first electrical contact 2334 of the frame 2324 included in the gun module 2302*b* utilize an RCA connection to couple the uphole line by way of the via 2344 and the ground to the housing 2304. The first electrical contact 2334 includes a ground portion 2301 configured to be connected to be directly or indirectly coupled to a ground wire. In some embodiments, the ground portion 2301 is directly or indirectly electrically connected to the housing 2304. The second electrical contact 2336 is also an RCA receptacle to utilize an RCA connection to couple the downhole line by way of the conductive material 2342 within the via 2344 of a gun module 2302*a* to provide electrical connection to the gun module 2302*a*, which is the downhole gun from the gun module 2302*b*. In this example embodiment, the second electrical contact 2336 includes a ground portion 2303 that is unused. The perforation tool 2300 has a detonator 2340 disposed in a detonator receptacle 2338, which is similar to the detonator receptacle 138 of the perforation tool 100 (FIG. 1).

The electrical connections discussed with respect to FIG. 23 are usable for embodiments in which the frame 2324 is replaced by a frame configured to hold one or more S-Charges such as those discussed with respect to FIGS. 19-21.

The perforation tool 2300 is similar to the perforation tool 2200, but with a different style of electrical connection between the gun modules 2302*a* and 2302*b*. Here, the detonator 2340 and conductive material 2342 of each gun module 2302*a* and 2302*b* is disposed along a central axis 2310 of the perforation tool 2300, but instead of the spring connector 2236, the perforation tool 2300 uses an electrical contact 2236 that is shaped to receive the end of the conductive material 2342, so that the electrical contact 2236 of the gun module 2302*b* receives the end of the conductive material 2342 of the gun module 2302*a* to make electrical connection.

Figure 24:
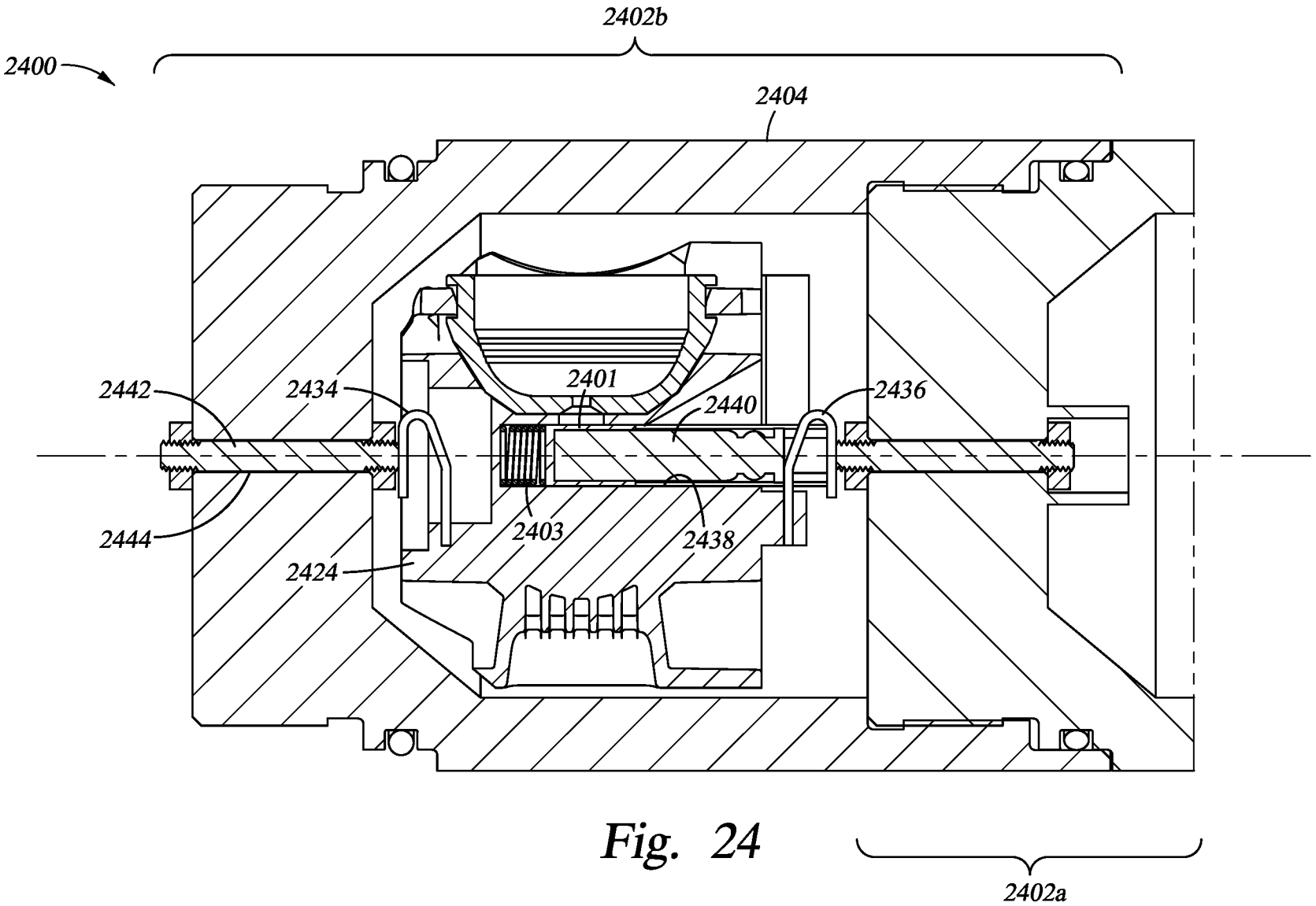
FIG. 24 is a cross-sectional view of a portion of a perforation tool according to one embodiment.

FIG. 24 is a cross-sectional view of a portion of the perforation tool 2400 according to one embodiment. The perforation tool 2400 is similar to the perforation tool 100 (FIG. 1), except that in this case the first electrical contact 2434 of the frame 2424 included in gun module 2402*b* is a spring contact that couples the uphole line by way of the conductive material 2442 in the via 2444. The second electrical contact 2436 is also a spring contact configured to couple the downhole line by way of the conductive material 2442 within the via 2444 of the gun module 2402*a* to transmit telemetry to the gun module 2402*a*, which is the downhole gun from the gun module 2402*b*.

The detonator 2440 is in the detonator receptacle 2438 and is surrounded by the safety sleeve 2401. With the next downhole housing 2404 of the next gun module 2402*a* attached, the spring 2403 is depressed, and the safety sleeve 2401 is deactivated. The safety sleeve 2401, however, is electrically coupled to the second electrical contact 2436 and is configured to serve as a ground connection when the gun module 2402*a* is attached to the gun module 2402*b*. The second electrical contact 2436 is connected directly or indirectly coupled by way of a ground wire to the safety sleeve 2401. The safety sleeve 2401 can be directly or indirectly electrically connected to the housing 2404 of one or more of the gun module 2402*a* or the gun module 2402*b*.

The electrical connections discussed with respect to FIG. 24 are usable for embodiments in which the frame 2424 is replace by an embodiment configured to hold one or more S-Charges such as those discussed with respect to FIGS. 19-21.

Figure 25:
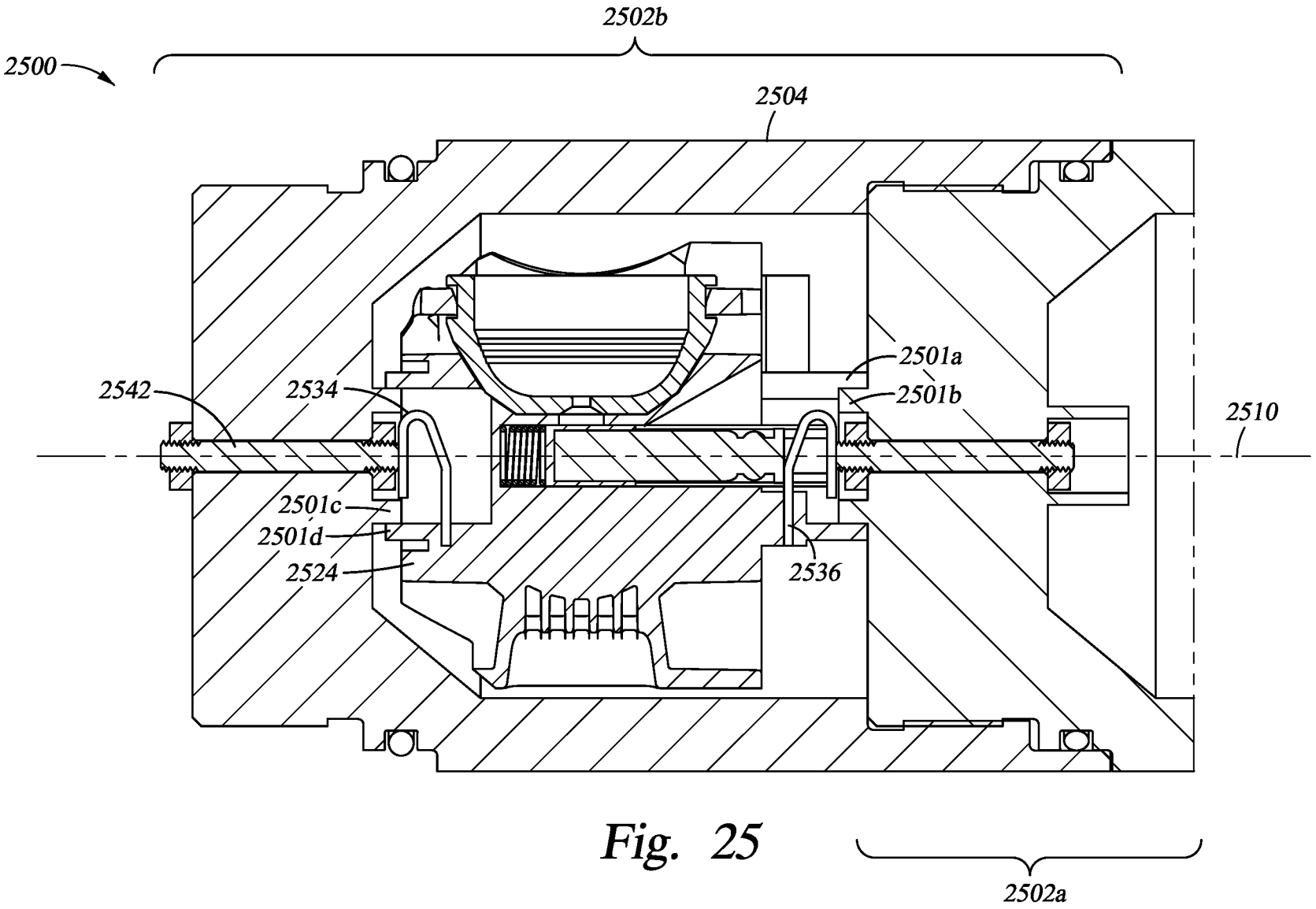
FIG. 25 is a cross-sectional view of a portion of a perforation tool according to one embodiment.

FIG. 25 is a cross-sectional view of a portion of a perforation tool 2500 according to one embodiment. The perforation tool 2500 is similar to the perforation tool 100 (FIG. 1) except that in this case, the first electrical contact 2534 and the second electrical contact 2536 are spring contacts. The gun module 2502*b* and the gun module 2502*a* include housings 2504 and frames 2524 that have complementary bearing assembly portions 2501*a*, 2501*b*, 2501*c* and 2501*d* (collectively referred to as "bearings 2501") that promote rotation of the frame 2524 with respect to the central axis 2510 within the housing 2504 of the sequential gun modules 2502. The spring contacts maintain the electrical connection with the conductive material 2542 of each of the sequential gun modules 2502 before, during and after an orientation process in which the frame 2524 is caused to rotate about central axis 2510.

The electrical connections discussed with respect to FIG. 25 are usable for embodiments in which the frame 2524 is replaced by an embodiment configured to hold one or more S-Charges such as those discussed with respect to FIGS. 19-21.

Figure 26:
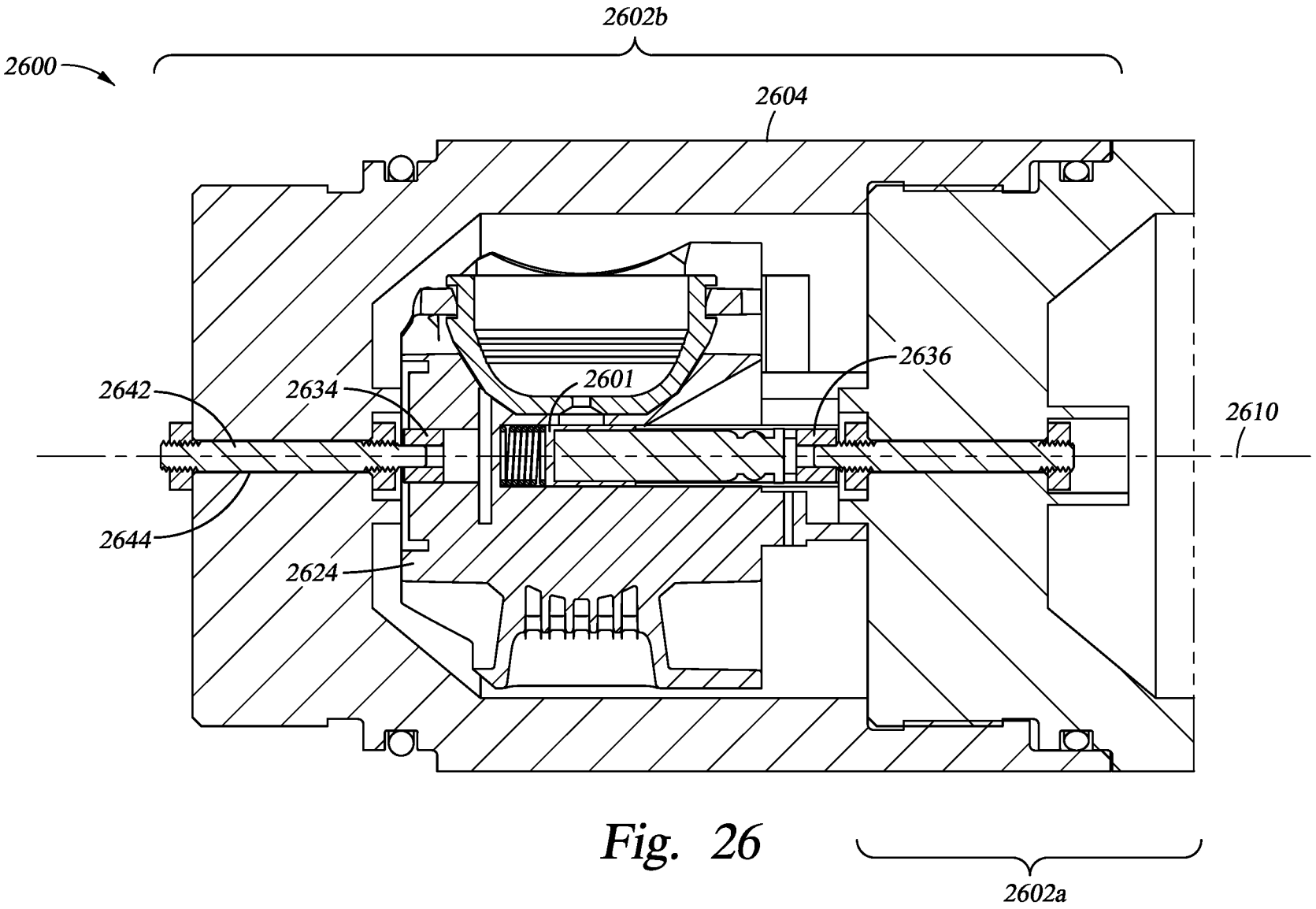
FIG. 26 is a cross-sectional view of a portion of a perforation tool according to one embodiment.

FIG. 26 is a cross-sectional view of a portion of the perforation tool 2600 according to one embodiment. The perforation tool 2600 is similar to the perforation tool 100 (FIG. 1), except that in this case the first electrical contact 2634 and the second electrical contact 2636 are bearings. The conductive material 2642 within the vias 2644 of each of the gun module 2602*b* and the gun module 2602*a* are inserted into the bearing electrical contacts. The bearing electrical contacts promote rotation of the frame 2624 with respect to central axis 2610 within the housing 2604 of the sequential gun modules 2602. The bearing contacts maintain the electrical connection with the conductive material 2642 of each of the sequential gun modules 2602 before, during and after an orientation process in which the frame 2624 is caused to rotate about the central axis 2610.

Here, the safety sleeve 2601 is used to connect the second electrical contact 2636 to ground. Alternately, the safety sleeve 2601 can be replaced by another suitable structure in frame 2624 to facilitate connectivity of the first electrical contact 2634 or the second electrical contact 2636 to ground.

The electrical connections discussed with respect to FIG. 26 are usable for embodiments in which the frame 2624 is replaced by an embodiment configured to hold one or more S-Charges such as those discussed with respect to FIGS. 19-21.

Figure 27:
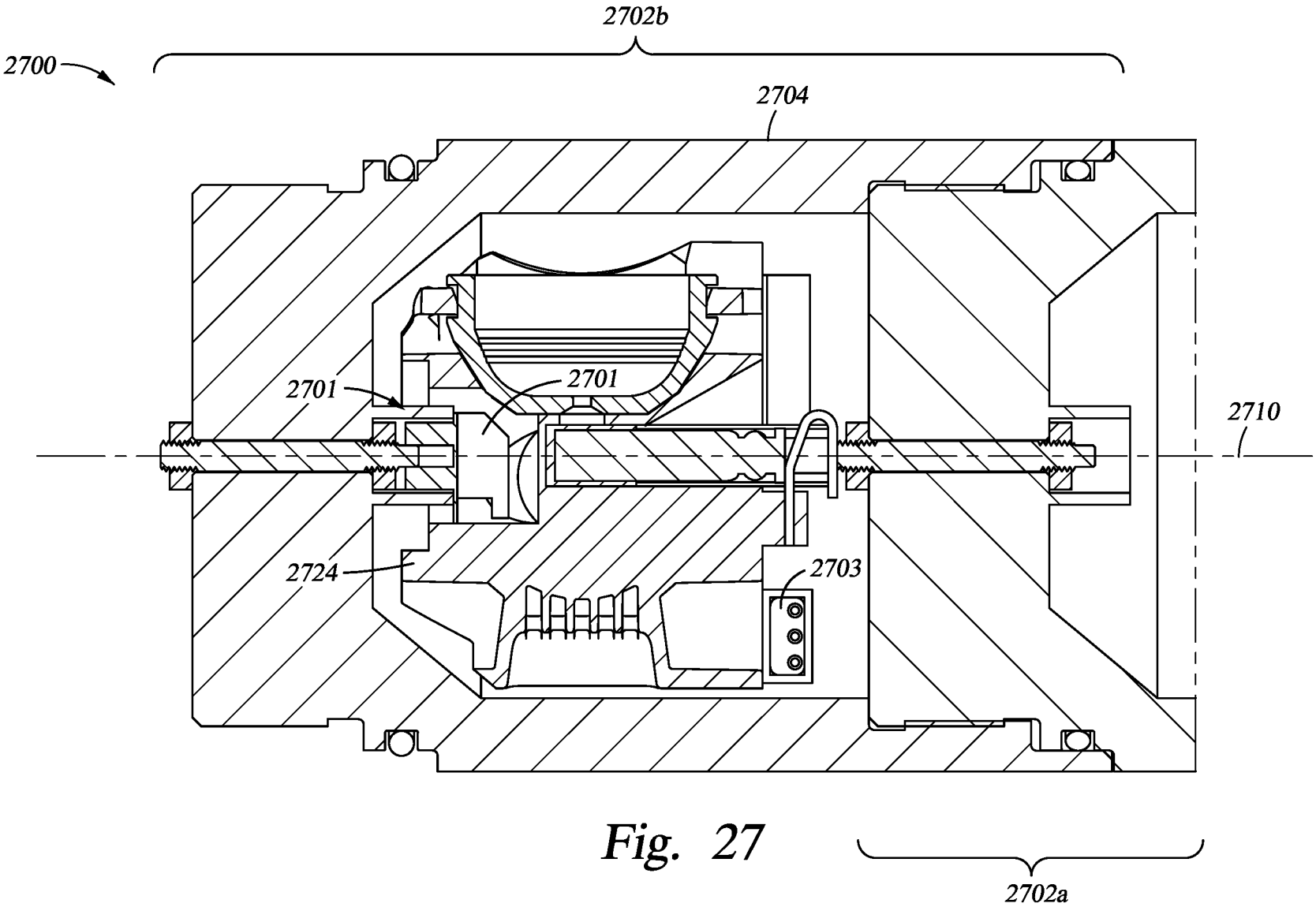
FIG. 27 is a cross-sectional view of a portion of a perforation tool according to one embodiment.

FIG. 27 is a cross-sectional view of a portion of a perforation tool 2700 according to one embodiment. The perforation tool 2700 is similar to the perforation tool 100 (FIG. 1), except that in this case the perforation tool 2700 is configured to actively rotate the frame 2724 holding one or more charges within the housing 2704. The perforation tool 2700 is thus usable to open a communication channel from the inside of housing to 2704 a geological formation. An optimal phasing or orientation to perforate the housing 2704 by detonating the charges held by one or more frames 2724 within the housing 2704 is dependent on the stresses in the formation. Perforating in the plane of maximum stress is optimal to create a transverse fracture in the formation. The maximum stress plane is usually assumed to be straight up in a horizontal well, which is the overburden stress. However, formations can change inclination, and a well might not be perfectly horizontal so the maximum stress plane might not be straight up in all cases. The ability to actively rotate and orient the frame 2724 provides phase targeting for such cases.

This example embodiment is configured to actively rotate one or more of the frames 2724 holding one or more charges within one or more housings 2704 of a single gun module 2702 or multiple gun modules 2702 to be aligned in the maximum stress direction. The maximum stress direction can be known before running the perforating gun, and the loading tubes rotated downhole. Or the maximum stress direction can be determined with a sonic tool attached to the perforating gun. Sonic tools to determine the stresses in varying directions in the formation already exist by using sonic waves to measure the density and stress in the formation 360 degrees around the housing 2704.

To facilitate the rotation of the frame 2724 about the central axis 2710 within the housing 2704, the gun module 2702 includes a rotary assembly 2701. Rotary assembly 2701 is communicatively coupled with a switch/controller module 2703. In some embodiments, the switch/controller module 2703 comprises a computer or processor-based system such as the computer or processor-based system 3000 (see FIG. 30). In some embodiments, the switch/controller module 2703 comprises an addressable switch configured to be communicatively connected with a computer or processor-based system such as the computer or processor-based system 3000. Rotary assembly 2701 comprises one or more magnets and coils configured to cause the frame 2724 to rotate based on an electric current supplied to the coils. The switch/controller module 2703 is configured to cause the electric current to be supplied to the coils included in rotary assembly.

The switch/controller module 2703 comprises a position sensor configured to detect an orientation of the frame 2724 or a charge held by the frame with respect to a reference position within the housing 2704. In some embodiments, the position sensor comprises one or more of a gyroscope, an accelerometer, a magnetometer, or some other suitable sensor capable of generating data for detecting an orientation of a structure with respect to a reference position within another structure or with respect to a reference axis. In some embodiments, the position sensor is separate from the switch/control module 2703 and a portion thereof is included in or attached to at least one of the frame 2724 or the housing 2704, and the position sensor is communicatively coupled with the switch/control module 2703 to provide data to the switch/control module 2703 for determining the orientation of the frame or charge held by the frame.

In some embodiments, the rotary assembly 2701 comprises a brushed motor, a brushless motor, a servo motor or a stepper motor on one of the frame 2724, the housing 2704 or between the housing 104 and the frame 2724. In some embodiments, the rotary assembly 2701 is made up of components included in the housing 2704 and the frame 2724.

The switch/controller module 2703 is configured to cause the frame 2724 to rotate about the central axis 2710 to an instructed position based on a detected orientation of the frame 2724 with respect to the reference position. In some embodiments the instructed position is based on a user-selected position communicated to the switch/controller module 2703 on demand. In some embodiments, the instructed position is automatically communicated to the switch/controller module 2703 based on data fed to the switch/controller module 2703 from at least one of the position sensor or a smart orienting perforating system that provides information regarding the optimal orientation to perforate is for a specific depth in the well. Switch/controller module 2703 is configured to take this information and cause the frame 2724 to rotate accordingly until the instructed orientation position is reached, based at least in part on data supplied to a processor included in switch/controller module 2703 from the position sensor. In some embodiments, based on the type of rotary assembly 2701 used, the switch/controller module 2703 is configured to cause the frame 2724 to be held in the instructed orientation position by continually supplying an electric current or a hold instruction to the rotary assembly 2701.

In an assembled perforation tool 2700 that comprises two or more gun modules 2702, the switch/controller module 2703 and/or the position sensor in a downhole gun module 2702 is electrically connected with a switch/controller module 2703 of an uphole gun module 2702. The switch/controller module 2703 of the uphole gun module 2702 is configured to determine the orientation of the frame 2724 and the charges held by the frame 2724 of the downhole gun module 2702 and the uphole gun module 2702.

In some embodiments, the perforation tool 2700 includes a plurality of gun modules 2702, and the switch/controller module 2703, or a master switch/controller module 2703 communicatively coupled with all of the switch/controller modules 2703 included in each gun module 2702, is configured to individually cause the frame 2724 included in the each gun module 2702 to rotate about the central axis 2710 with respect to a corresponding reference position associated with the housing 2704 of a corresponding one of the gun modules 2702 to achieve an instructed orientation position of the charges positioned by one or more of the frames 2724 included in the gun modules 2702 of the perforation tool 2700.

The capabilities of the rotary assembly 2701 and the switch/controller module 2703 discussed with respect to FIG. 27 are usable where the frame 2724 is replaced by a frame configured to hold one or more S-Charges such as those discussed with respect to FIGS. 19-21.

Figure 28:
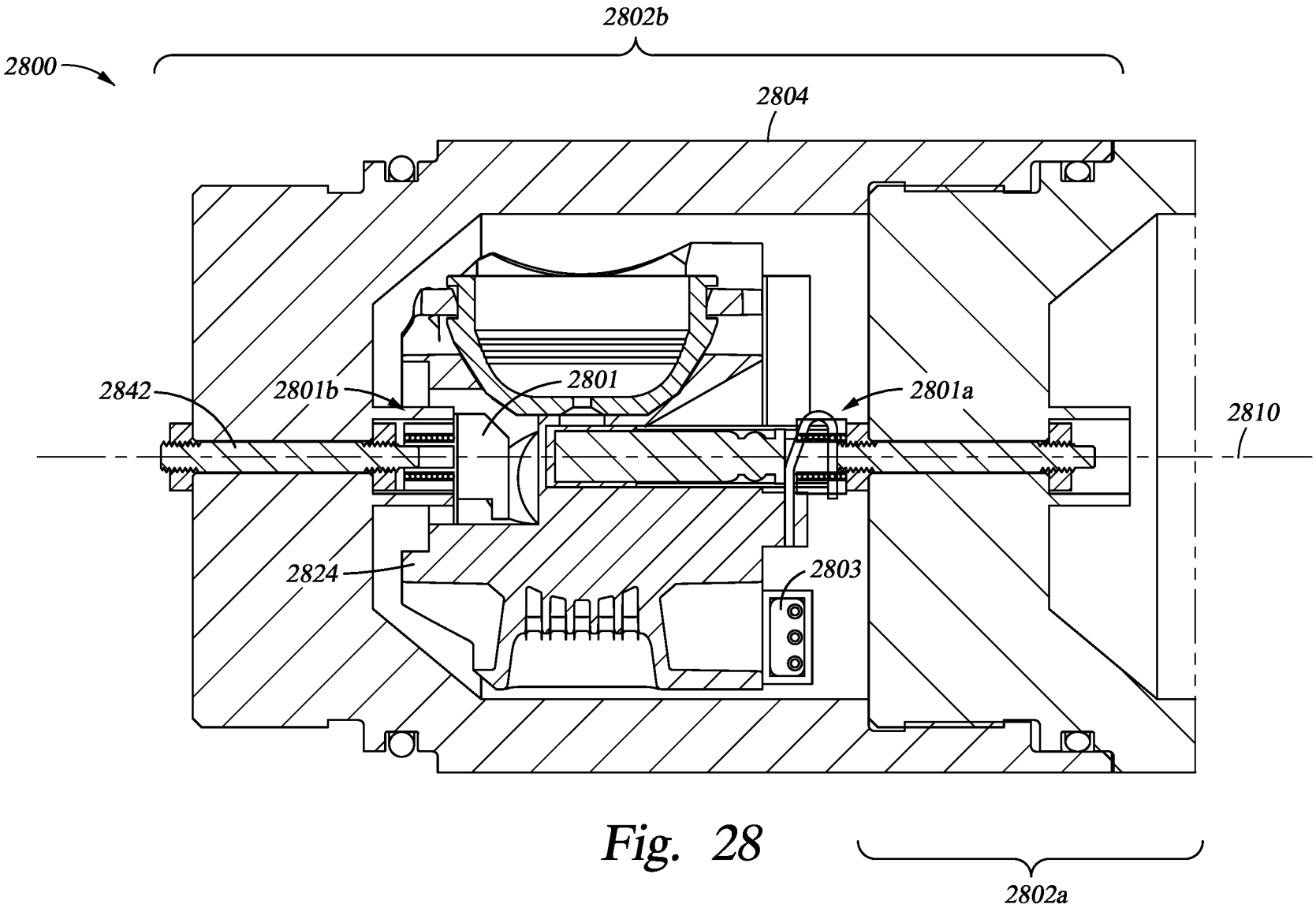
FIG. 28 is a cross-sectional view of a portion of a perforation tool according to one embodiment.

FIG. 28 is a cross-sectional view of a portion of a perforation tool 2800 according to one embodiment. The perforation tool 2800 is similar to the perforation tool 2700 (FIG. 27), except in this case the gun module 2802*a* includes rotary assemblies 2801*a* and 2801*b* (collectively referred to as "rotary assembly 2801") that are communicatively coupled with a switch/controller module 2803. Each rotary assembly 2801 comprises one or more magnets and coils configured to cause the frame 2824 to rotate based on an electric current supplied to the coils. The switch/controller module 2803 is configured to cause the electric current to be supplied to the coils included in the rotary assembly 2801. In some embodiments, only one of the rotary assembly 2801*a* or the rotary assembly 2801*b* is included and the other end of the frame is rotatable within housing 2804. The housing 2804 of at least one of the gun module 2802*a* or the gun module 2802*b* comprises a stator portion of the rotary assembly 2801, the frame 2824 comprises a rotor portion of the rotary assembly 2801, and the stator portion is configured to be accommodated inside the rotor portion of the rotary assembly 2801. For example, the rotary assembly 2801*a* includes a fixed magnet attached to the conductive material 2842 of the gun module 2802*a*, and the rotary assembly 2801*b* includes a fixed magnet attached to the conductive material 2842 of the gun module 2802*b*. The frame 2824 includes coils and a polar-opposite magnets within which the magnets at the end of each of the conductive materials 2842 is inserted. The coils and polar-opposite magnets are fixed with respect to the frame 2824. Based on an electric current supplied to the coils, the frame is caused to rotate about the central axis 2810. For example, the rotary assemblies 2801 as shown include a magnet (+) surrounding coils with a magnet (−) in the center. The switch/controller module 2803 causes an electric current to be supplied to the coils. When the coils have current flow, the frame 2824 will rotate due to a magnetic force that is generated.

The switch/controller module 2803 controls the power sent to the coil(s) based on the data supplied by the position sensor regarding the position and/or orientation of the frame 2824 with respect to the reference position within the housing 2804, a reference axis or the central axis 2810. The switch/controller module 2803 controls the power sent to the coil(s) to start/stop the power sent to the coil to either start/stop the rotation to one or more of achieve the instructed position or maintain the instructed position.

The capabilities of the rotary assembly 2801 and the switch/controller module 2803 discussed with respect to FIG. 28 are usable for embodiments in which the frame 2824 is replaced by an embodiment configured to hold one or more S-Charges such as those discussed with respect to FIGS. 19-21.

Figure 29:
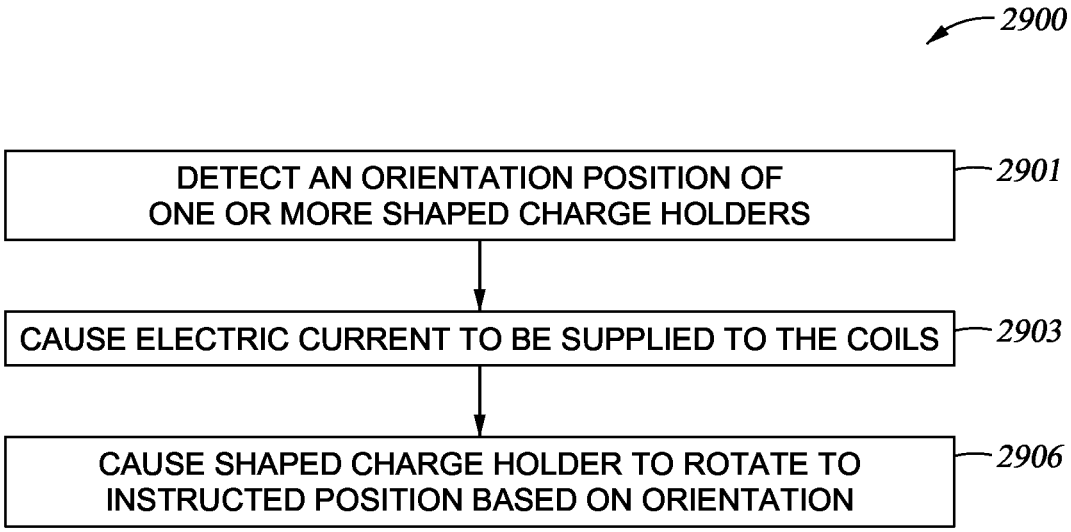
FIG. 29 is a flowchart of a method of orienting one or more shaped charges included in a perforation tool according to one embodiment.

FIG. 29 is a flowchart of a method 2900 of orienting one or more shaped charges included in a perforation tool according to one embodiment. At 2901, a processor such as that included in switch/controller module 2703 (FIG. 27) or 2803 (FIG. 28), or a computer based system such as system 3000 (FIG. 30), detects an orientation position of one or more shaped charge holders included in a perforation gun assembly.

The perforation gun assembly comprises two or more gun modules. Each gun module comprises a housing having a first end, a second end opposite the first end, a first length extending in an axial direction from the first end of the housing to the second end of the housing along a central axis, and at least one sidewall defining a cavity within the housing, the at least one sidewall having a first thickness in a direction parallel to the central axis between a first exterior surface of the at least one sidewall on the first end of the housing and a first interior surface portion of the at least one sidewall on a first end-side of the cavity, and a second thickness in a radial direction with respect to the central axis, the second thickness being less than the first thickness and between a second exterior surface of the at least one sidewall and a second interior surface portion of the at least one sidewall, the second interior surface portion of the at least one sidewall being between the first interior surface portion of the at least one sidewall and the second end of the housing. Each gun module also comprises a detonator. Each gun module further comprises at least one shaped charge holder of the one or more shaped charge holders inside the cavity within the housing, the at least one shaped charge holder having a first end facing the first interior surface portion of the housing, a second end opposite the first end, a second length less than the first length extending from the first end of the at least one shaped charge holder to the second end of the at least one shaped charge holder along the central axis, one or more charge receptacles between the first end of the at least one shaped charge holder and the second end of the at least one shaped charge holder, each of the one or more charge receptacles being configured to accommodate at least a portion of a shaped charge, a first electrical contact on a first end-side of the at least one shaped charge holder, a second electrical contact on a second end-side of the at least one shaped charge holder, and a detonator receptacle configured to accommodate the detonator between the first electrical contact and the second electrical contact. Each gun module additionally comprises a conductive material communicatively coupled with the first electrical contact, wherein the first end of a first gun module of the two or more gun modules is connected to the second end of a second gun module of the two or more gun modules, the conductive material of the first gun module is electrically connected to the second electrical contact of the second gun module, and the shaped charge holder is rotatable about the central axis within the housing. Each gun module also comprises a rotary assembly comprising one or more magnets and coils configured to cause the shaped charge holder of the corresponding one of the first gun module or the second gun module to rotate based on an electric current supplied to the coils.

At 2903, electric current is caused to be supplied to the coils included in at least one of the first gun module or the second gun module to cause at least one of the shaped charge holder included in the first gun module or the shaped charge holder included in the second gun module to rotate about the central axis to an instructed position with respect to the corresponding housing of the first gun module or the second gun module.

At 2906, the shaped charge holder included in the first gun module or the second gun module is individually caused to rotate about the central axis to the instructed position based on a detected orientation of the shaped charge holder with respect to a reference position. At least one of the first gun module or the second gun module further comprises a position sensor in the shaped charge holder or the housing configured to detect the orientation of the shaped charge holder with respect to the reference position within the housing.

Figure 30:
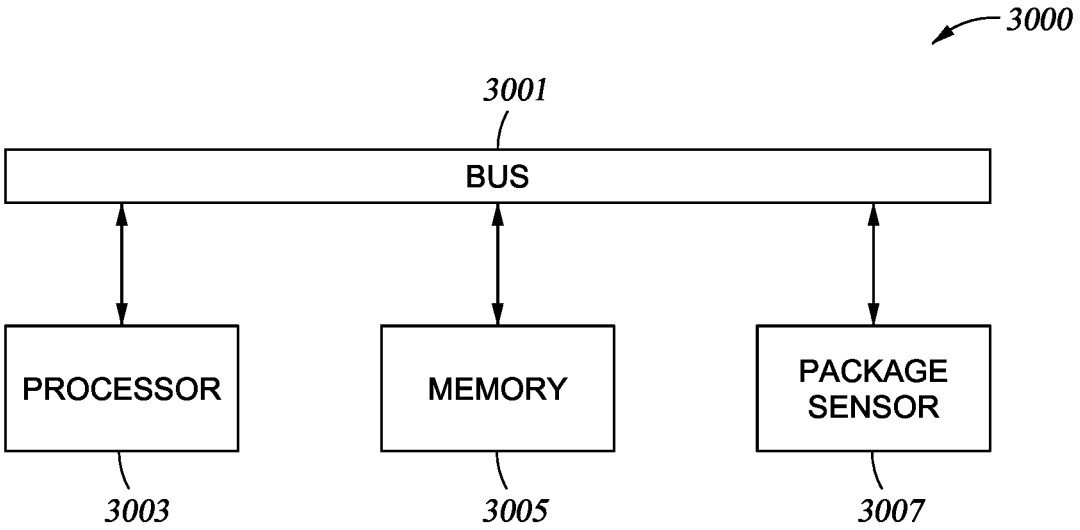
FIG. 30 is a functional block diagram of a computer or processor-based system upon which or by which some embodiments are implemented.

FIG. 30 is a functional block diagram of a computer or processor-based system 3000 upon which or by which an embodiment is implemented. Processor-based system 3000 is programmed to one or more of provide an electrical signal to initiate an explosive device, detect an orientation of one or more components of a gun module, or cause an orientation of a portion of a gun module to change, as described herein, and includes, for example, bus 3001, processor 3003, and memory 3005 components. System 3000 optionally comprises a sensor package 3007 comprising one or more of a gyroscope, a magnetometer, an accelerometer, or other suitable sensor capable of generating data usable by a processor to determine an orientation of an object associated with the sensor.

The processor-based system can be implemented as a single "system on a chip." Processor-based system 3000, or a portion thereof, constitutes a mechanism for performing one or more steps of one or more of providing an electrical signal to initiate an explosive device, detecting an orientation of one or more components of a gun module, or causing an orientation of a portion of a gun module to change.

In some cases, the processor-based system 3000 includes a communication mechanism such as bus 3001 for transferring information and/or instructions among the components of the processor-based system 3000. Processor 3003 is connected to the bus 3001 to obtain instructions for execution and process information stored in, for example, the memory 3005. The processor 3003 can also use one or more specialized components to perform certain processing functions and tasks such as one or more digital signal processors (DSP), or one or more application-specific integrated circuits (ASIC). A DSP typically is configured to process real-world signals (e.g., sound) in real time independently of the processor 3003. Similarly, an ASIC is configurable to perform specialized functions not easily performed by a more general purpose processor. Other specialized components to aid in performing the functions described herein optionally include one or more field programmable gate arrays (FPGA), one or more controllers, or one or more other special-purpose computer chips.

The processor (or multiple processors) 3003 can be configured to perform a set of operations on information as specified by a set of instructions stored in memory 3005 related to one or more of providing an electrical signal to initiate an explosive device, detecting an orientation of one or more components of a gun module, or causing an orientation of a portion of a gun module to change. The execution of the instructions causes the processor to perform specified functions.

The processor 3003 and accompanying components are connected to the memory 3005 via the bus 3001. The memory 3005 includes one or more of dynamic memory (e.g., RAM, magnetic disk, writable optical disk, etc.) and static memory (e.g., ROM, CD-ROM, etc.) for storing executable instructions that when executed perform the steps described herein to one or more of provide an electrical signal to initiate an explosive device, detect an orientation of one or more components of a gun module, or cause an orientation of a portion of a gun module to change. The memory 3005 also stores the data associated with or generated by the execution of the steps.

A memory 3005, such as a random access memory (RAM) or any other dynamic storage device, can be used to store information including processor instructions for one or more of providing an electrical signal to initiate an explosive device, detecting an orientation of one or more components of a gun module, or causing an orientation of a portion of a gun module to change. Dynamic memory allows information stored therein to be changed. RAM allows a unit of information stored at a location called a memory address to be stored and retrieved independently of information at neighboring addresses. The memory 3005 is also used by the processor 3003 to store temporary values during execution of processor instructions. The memory 3005 can be a read only memory (ROM) or any other static storage device coupled to the bus 3001 for storing static information, including instructions, that is not capable of being changed by processor 3003. Some memory is composed of volatile storage that loses the information stored thereon when power is lost. The memory 3005 can be a non-volatile (persistent) storage device, such as a magnetic disk, optical disk or flash card, for storing information, including instructions, that persists even when the system 3000 is turned off or otherwise loses power.

The term "computer-readable medium" as used herein refers to any medium that participates in providing information to processor 3003, including instructions for execution. Such a medium takes many forms, including, but not limited to computer-readable storage medium (e.g., non-volatile media, volatile media). Non-volatile media includes, for example, optical or magnetic disks. Volatile media include, for example, dynamic memory. Common forms of computer-readable media include, for example, a floppy disk, a flexible disk, a hard disk, a magnetic tape, another magnetic medium, a CD-ROM, CDRW, DVD, another optical medium, punch cards, paper tape, optical mark sheets, another physical medium with patterns of holes or other optically recognizable indicia, a RAM, a PROM, an EPROM, a FLASH-EPROM, an EEPROM, a flash memory, another memory chip or cartridge, or another medium from which a computer can read. The term computer-readable storage medium is used herein to refer to a computer-readable medium.

While the foregoing is directed to embodiments of the present invention, other and further embodiments of the present disclosure may be devised without departing from the basic scope thereof, and the scope thereof is determined by the claims that follow.

What is claimed is:

1. An apparatus, comprising:

a one-piece housing having a first end, a second end opposite the first end, a length in an axial direction from the first end to the second end along a central axis of the one-piece housing, an end wall at the first end, and a sidewall joined to the end wall, extending from the first end to the second end, and defining a cavity within the one-piece housing;

a frame inside the cavity, the frame having a first end facing the end wall of the housing and a second end opposite the first end, the frame comprising:

a charge receptacle between the first end of the frame and the second end of the frame to accommodate at least a portion of a shaped charge;

a detonator receptacle to accommodate a detonator, the detonator receptacle having fluid communication with the charge receptacle; and a control switch receptacle; and a rotary assembly coupled to the frame and comprising one or more magnets and coils, wherein the rotary assembly is positioned inside the cavity and is configured to rotate the frame about the central axis.

2. The apparatus of claim 1, wherein the control switch receptacle is oriented in a radial direction relative to the central axis of the one-piece housing and configured to receive one or more of a switch or a controller in the radial direction into the control switch receptacle.

3. The apparatus of claim 1, wherein the rotary assembly is at least partially recessed axially into the frame.

4. The apparatus of claim 1, further comprising a shaped charge disposed in the charge receptacle and a detonator disposed in the detonator receptacle.

5. The apparatus of claim 1, further comprising a sleeve disposed in the detonator receptacle and surrounding the detonator such that the sleeve is configured to move axially between first and second positions, the detonator is unarmed in the first position of the sleeve, and the detonator is armed in the second position of the sleeve.

6. The apparatus of claim 1, further comprising a detonator transport receptacle configured to accommodate the detonator in an unarmed state isolated from a shaped charge disposed in the charge receptacle.

7. The apparatus of claim 1, wherein the frame further comprises one or more weights offset from the central axis coupled to the frame to cause the frame to rotate within the one-piece housing based on a position of the one or more weights in the frame.

8. The apparatus of claim 1, wherein the rotary assembly comprises a first rotary component coupled to the first end of the frame and a second rotary component coupled to the second end of the frame, and the first rotary component is disposed between the end wall and the frame.

9. The apparatus of claim 1, wherein the detonator receptacle extends over a first axial distance along the central axis, the rotary assembly extends over a second axial distance along the central axis, and the first and second axial distances overlap one another along the central axis.

10. The apparatus of claim 8, wherein the one-piece housing comprises a stator portion of the rotary assembly, the frame comprises a rotor portion of the rotary assembly, and the stator portion is located inside the rotor portion.

11. The apparatus of claim 5, further comprising a spring disposed in the detonator receptacle to prevent ballistic transfer between the detonator receptacle and the charge receptacle until the spring is compressed.

12. A perforation gun assembly, comprising:

two or more gun modules, each gun module comprising:

a one-piece housing having a first end, a second end opposite the first end, a length in an axial direction from the first end to the second end along a central axis of the one-piece housing, an end wall at the first end, and a sidewall joined to the end wall, extending from the first end to the second end, and defining a cavity within the one-piece housing, the end wall having a thickness greater than a thickness of the sidewall;

a sleeve;

a detonator disposed in the sleeve;

a frame inside the cavity, the frame having a first end facing the end wall of the one-piece housing and a second end opposite the first end, the frame comprising:

a charge receptacle between the first end of the frame and the second end of the frame to accommodate at least a portion of a shaped charge;

a first electrical contact at the first end of the frame;

a second electrical contact at the second end of the frame;

a detonator receptacle to accommodate the detonator disposed in the sleeve between the first electrical contact and the second electrical contact, wherein the sleeve is configured to move axially in the detonator receptacle between first and second positions, the detonator is unarmed in the first position of the sleeve, and the detonator is armed in the second position of the sleeve; and a control switch receptacle; and a conductive material communicatively coupled with the first electrical contact, wherein the first end of the one-piece housing of a first gun module of the two or more gun modules is connected to the second end of the one-piece housing of a second gun module of the two or more gun modules, and the conductive material of the first gun module is electrically connected to the second electrical contact of the second gun module.

13. The perforation gun assembly of claim 12, wherein each one-piece housing is cylindrical, and a first diameter of the first end of each one-piece housing is less than a second diameter of the second end of each housing such that the first end of the one-piece housing of the first gun module fits into the second end of the one-piece housing of the second gun module and moves the sleeve of the second gun module from the first position to the second position.

14. The perforation gun assembly of claim 12, wherein the frame of at least one of the gun modules is rotatable about a central axis within the corresponding one-piece housing, and the respective gun module further comprises:

a rotary assembly coupled to the frame and comprising one or more magnets and coils, wherein the rotary assembly is inside the cavity and configured to cause the frame to rotate based on an electric current supplied to the coils; and a controller communicatively coupled with the and configured to control the electric current supplied to the coils.

15. The perforation gun assembly of claim 14, wherein the rotary assembly comprises a first rotary component coupled to the first end of the frame and a second rotary component coupled to the second end of the frame, and the first rotary component is disposed between the end wall and the frame.

16. The perforation gun assembly of claim 12, wherein the sleeve has one or more first openings, the detonator receptacle has one or more second openings into the charge receptacle, the sleeve separates the one or more first openings from the one or more second openings in the first position of the sleeve, and the sleeve aligns the one or more first openings with the one or more second openings in the second position of the sleeve.

17. The apparatus of claim 12, wherein the sleeve is coupled to a spring configured to move the sleeve between the first position and the second position.

18. An apparatus, comprising:

at least one processor;

a memory having computer readable instructions stored thereon that, when executed by the at least one processor, cause the apparatus to:

detect an orientation position of one or more shaped charge holders of a perforation gun assembly, the perforation gun assembly comprising:

two or more gun modules, each gun module comprising:

a one-piece housing having a first end, a second end opposite the first end, a length in an axial direction from the first end to the second end along a central axis of the one-piece housing, an end wall at the first end, and a sidewall joined to the end wall, extending from the first end to the second end, and defining a cavity within the one-piece housing, the end wall having a thickness greater than a thickness of the sidewall;

a detonator;

a shaped charge holder inside the cavity and having a first end facing the end wall and a second end opposite the first end, the shaped charge holder comprising:

one or more charge receptacles between the first end of the shaped charge holder and the second end of the shaped charge holder, each charge receptacle being configured to accommodate at least a portion of a shaped charge;

a first electrical contact at the first end of the shaped charge holder;

a second electrical contact at the second end of the shaped charge holder; and a detonator receptacle to accommodate the detonator between the first electrical contact and the second electrical contact;

a conductive material communicatively coupled with the first electrical contact, wherein the first end of the one-piece housing of a first gun module of the two or more gun modules is connected to the second end of the one-piece housing of a second gun module of the two or more gun modules, the conductive material of the first gun module is electrically connected to the second electrical contact of the second gun module, wherein one or more shaped charge holders is rotatable about the central axis within the corresponding one-piece housing; and a rotary assembly respectively coupled to each rotatable shaped charge holder, the rotary assembly comprising one or more magnets and coils, wherein the rotary assembly is positioned inside the cavity and is configured to cause the rotatable shaped charge holder to rotate about the central axis based on an electric current supplied to the coils; and to cause the electric current to be supplied to the coils to cause each of the rotatable shaped charge holders to rotate to an instructed position with respect to the corresponding one-piece housing.

19. The apparatus of claim 18, further comprising a position sensor in each rotatable shaped charge holder, or the corresponding one-piece housing thereof, configured to detect the orientation of the shaped charge holder with respect to a reference position within the corresponding one-piece housing, and the apparatus is further caused to:

cause the rotatable shaped charge holder to rotate to the instructed position based on the detected orientation of the rotatable shaped charge holder with respect to the corresponding reference position.

20. The apparatus of claim 18, wherein the rotary assembly is at least partially recessed axially into the frame.

21. A method, comprising:

detecting, by a processor, an orientation position of one or more shaped charge holders included in a perforation gun assembly, comprising:

two or more gun modules, each gun module comprising:

a housing having a first end, a second end opposite the first end, a length in an axial direction from the first end to the second end along a central axis, an end wall at the first end, and a sidewall joined to the end wall, extending from the first end to the second end, and defining a cavity within the housing, the end wall having a thickness greater than a thickness of the sidewall;

a detonator;

a shaped charge holder inside the cavity and having a first end facing the end wall and a second end opposite the first end, the shaped charge holder comprising:

one or more charge receptacles between the first end of the shaped charge holder and the second end of the shaped charge holder, each charge receptacle being configured to accommodate at least a portion of a shaped charge;

a first electrical contact at the first end of the shaped charge holder;

a second electrical contact at the second end of the shaped charge holder; and a detonator receptacle to accommodate the detonator between the first electrical contact and the second electrical contact;

a conductive material communicatively coupled with the first electrical contact, wherein the first end of the housing of a first gun module of the two or more gun modules is connected to the second end of the housing of a second gun module of the two or more gun modules, the conductive material of the first gun module is electrically connected to the second electrical contact of the second gun module, wherein one or more shaped charge holders is rotatable about the central axis within the corresponding housing; and a rotary assembly for each rotatable shaped charge holder, the rotary assembly comprising one or more magnets and coils, wherein the rotary assembly is positioned inside the cavity and is configured to cause the rotatable shaped charge holder to rotate about the central axis based on an electric current supplied to the coils; and causing the electric current to be supplied to the coils to cause the rotatable shaped charge holders to rotate to an instructed position with respect to the corresponding housing.

22. The method of claim 21, wherein at least one of the first gun module or the second gun module further comprises a position sensor in the shaped charge holder or the housing configured to detect the orientation of the shaped charge holder with respect to a reference position within the housing, and the method further comprises:

causing the shaped charge holder included in the first gun module or the second gun module to rotate about the central axis to the instructed position based on the detected orientation of the shaped charge holder with respect to the reference position.

23. A non-transitory computer readable medium having instructions stored thereon that, when executed by at least one processor, cause an apparatus to:

detect an orientation position of one or more shaped charge holders included in a perforation gun assembly, comprising:

two or more gun modules, each gun module comprising:

a housing having a first end, a second end opposite the first end, a first length extending in an axial direction from the first end of the housing to the second end of the housing along a central axis, and at least one sidewall defining a cavity within the housing, the at least one sidewall having a first thickness in a direction parallel to the central axis between a first exterior surface of the at least one sidewall on the first end of the housing and a first interior surface portion of the at least one sidewall on a first end-side of the cavity, and a second thickness in a radial direction with respect to the central axis, the second thickness being less than the first thickness and between a second exterior surface of the at least one sidewall and a second interior surface portion of the at least one sidewall, the second interior surface portion of the at least one sidewall being between the first interior surface portion of the at least one sidewall and the second end of the housing;

a detonator;

at least one shaped charge holder of the one or more shaped charge holders inside the cavity within the housing, the at least one shaped charge holder having a first end facing the first interior surface portion of the housing, a second end opposite the first end, a second length less than the first length extending from the first end of the at least one shaped charge holder to the second end of the at least one shaped charge holder along the central axis, one or more charge receptacles between the first end of the at least one shaped charge holder and the second end of the at least one shaped charge holder, each of the one or more charge receptacles being configured to accommodate at least a portion of a shaped charge, a first electrical contact on a first end-side of the at least one shaped charge holder, a second electrical contact on a second end-side of the at least one shaped charge holder, and a detonator receptacle configured to accommodate the detonator between the first electrical contact and the second electrical contact;

a conductive material communicatively coupled with the first electrical contact, wherein the first end of a first gun module of the two or more gun modules is connected to the second end of a second gun module of the two or more gun modules, the conductive material of the first gun module is electrically connected to the second electrical contact of the second gun module, and the shaped charge holder of is rotatable about the central axis within the housing; and a rotary assembly coupled to a frame supporting the at least one shaped charge holder and comprising one or more magnets and coils, wherein the rotary assembly is positioned inside the cavity and is configured to rotate the frame and the at least one shaped charge holder about the central axis; and cause an electric current to be supplied to the coils included in at least one of the first gun module or the second gun module to cause the shaped charge holder of the corresponding one of the first gun module or the second gun module to rotate about the central axis to an instructed position with respect to the corresponding housing of the first gun module or the second gun module.

24. The non-transitory computer readable medium of claim 23, wherein at least one of the first gun module or the second gun module further comprises a position sensor in the shaped charge holder or the housing configured to detect the orientation of the shaped charge holder with respect to a reference position within the housing, and the apparatus is further caused to:

cause the shaped charge holder included in the first gun module or the second gun module to rotate about the central axis to the instructed position based on the detected orientation of the shaped charge holder with respect to the reference position.

* * * * *